US009714490B2

(12) United States Patent
Tansley

(10) Patent No.: US 9,714,490 B2
(45) Date of Patent: Jul. 25, 2017

(54) BRIDGE

(71) Applicant: 1910623 ALBERTA LTD., Calgary (CA)

(72) Inventor: Mark G. Tansley, Alberta (CA)

( * ) Notice: Subject to any disclaimer, the term of this patent is extended or adjusted under 35 U.S.C. 154(b) by 0 days.

(21) Appl. No.: 14/937,572

(22) Filed: Nov. 10, 2015

(65) Prior Publication Data

US 2016/0362853 A1 Dec. 15, 2016

Related U.S. Application Data

(60) Provisional application No. 62/173,063, filed on Jun. 9, 2015.

(51) Int. Cl.
*E01D 15/14* (2006.01)
*E01D 11/00* (2006.01)
*E01D 18/00* (2006.01)

(52) U.S. Cl.
CPC ..... *E01D 15/145* (2013.01); *E01D 11/00* (2013.01); *E01D 18/00* (2013.01)

(58) Field of Classification Search
CPC ..... E01D 15/14; E01D 15/145; E01D 11/00; E01D 18/00
USPC ..... 14/2.6, 18–21
See application file for complete search history.

(56) References Cited

U.S. PATENT DOCUMENTS 3,685,074 A * 8/1972 Marshall ..... E01D 11/02 14/18
4,297,759 A * 11/1981 Soffge ..... E01D 15/22 14/2.6
4,488,833 A 12/1984 Perry et al.
4,797,026 A 1/1989 Webster
4,825,494 A 5/1989 King
4,890,959 A 1/1990 Robishaw et al.
5,967,694 A * 10/1999 Covarrubias ..... E01C 9/08 14/2.6
6,381,792 B1 * 5/2002 Woodfin ..... E01D 15/14 14/2.6

(Continued)

FOREIGN PATENT DOCUMENTS

CA 2502746 A1 9/2006
CA 2699910 A1 10/2011

(Continued)

OTHER PUBLICATIONS

Pihlainen, John A., Technical Report 97, A Review of Muskeg and its Associated Engineering Poblems, US Army Material Command, Cold Regions Research & Engineering Laboratory (69 pages) Dec. 31, 1963.

*Primary Examiner* — Raymond W Addie
(74) *Attorney, Agent, or Firm* — Jackson Walker LLP

(57) ABSTRACT

A bridge and method of installing the bridge for spanning a hydrological surface feature. The bridge includes a deck spanning the hydrological surface feature, at least one tower, and a tensile support system connecting the deck with the tower under tension to provide a tensile force for supporting the deck. A density and surface area of the deck, and the tensile force provided by the tensile support system, are selected to facilitate flotation of the deck on the hydrological feature with a top surface of the deck at a selected elevation above a surface the hydrological surface feature while supporting a selected load and while the deck is supported by the tensile force.

54 Claims, 16 Drawing Sheets

(56) References Cited

U.S. PATENT DOCUMENTS

| | | | | |
|---|---|---|---|---|
| 7,200,887 | B1 * | 4/2007 | Powers | E01D 15/14 14/2.4 |
| 7,249,912 | B2 | 7/2007 | Reese | |
| 7,717,642 | B2 * | 5/2010 | Patten | E01D 19/02 114/264 |
| 8,832,891 | B2 * | 9/2014 | Bringedal | E01D 15/14 14/2.6 |
| 2009/0038088 | A1 | 2/2009 | Adler et al. | |
| 2011/0217117 | A1 | 9/2011 | Halahmi et al. | |

FOREIGN PATENT DOCUMENTS

| | | | |
|---|---|---|---|
| JP | 2655398 | B2 | 9/1997 |
| WO | 8903454 | | 4/1989 |
| WO | 2006065041 | A1 | 6/2006 |
| WO | 2007096682 | A2 | 8/2007 |
| WO | 2009026807 | A1 | 3/2009 |

* cited by examiner

BRIDGE

CROSS REFERENCE TO RELATED APPLICATIONS

This application claims the benefit of priority of U.S. Provisional Patent Application No. 62/173,063 filed Jun. 9, 2015, which is hereby incorporated by reference.

FIELD

The present disclosure relates generally to providing a bridge across water bodies, or wetlands and similar unstable terrain.

BACKGROUND

When exploiting oil, gas, mineral, timber, or other natural resources, it is often necessary to move heavy equipment long distances through wilderness or other undeveloped terrain which lacks permanent roadways. In addition to the lack of roadways, such undeveloped terrain often includes wetlands, muskeg, water bodies, or other unstable terrain which may result in heavy equipment sinking, losing traction, or being otherwise delayed. A variety of solutions have been provided, including temporary or permanent bridges, swamp mats, rig mats, and access mats.

Previous systems necessarily balanced between ability to carry the required loads, durability, cost and ease of installation. The required loads and durability define requirements of the previous systems. The cost and ease of installation of any such system would be constrained and determined by the required load and required durability. Durability may be particularly important where the road or bridge is intended to remain in place during inhospitable portions of the year in climates which experience extreme temperatures, humidity, or other factors which result in increased wear. In addition, any solution for providing access to remote locations will often traverse fragile ecosystems which are subject to local regulation, public pressure, or both.

Muskeg or similar wetlands may be difficult to use as a subgrade in road construction. When a road is built over such terrain, road failure may result from lateral flow (shear) or compression (excessive settlement). Failure due to lateral flow may occur when the subsurface is pushed out from underneath the road as a result of gravitational force of the road on the subsurface, resulting in the road subsiding into the subsurface which remains under the road.

SUMMARY

Herein disclosed is a method and system for providing a bridge across wetlands, water bodies or other hydrological surface features. Travelling across water with land vehicles or on foot requires a bridge. Travelling across wetlands or other unstable terrain is also challenging, particularly with heavy machinery or other equipment, as such terrain lacks hard packed surfaces suitable for travelling drive across and is also inconvenient for pedestrians. It is, therefore, desirable to provide a solution which facilitates travelling across water, or wetlands or other unstable terrain, particularly with heavy equipment. It is an object of the present disclosure to obviate or mitigate at least one disadvantage of previous bridges and access mats.

The method and system described herein allow placement of a bridge between first and second stable terrain locations and across a hydrological surface feature. The hydrological surface feature may be water or wetlands (e.g. marsh, swamp, peat bog, muskeg, bogland, etc.). A deck with a density selected to provide buoyancy in the hydrological surface feature is positioned between the first and second locations. At least one tower is anchored either in the hydrological surface feature or in the stable terrain locations. Cable or a similar tensile support member extends between the tower and the deck. The support member is connected with the deck from above and is in tension to support the deck over the hydrological surface feature. The deck is secured on top of the hydrological feature by a combination of buoyant force and tensile force to support traffic for which a particular bridge is designed (e.g. heavy equipment, standard roadway traffic, pedestrian traffic, etc.). The density and surface area of the deck, and the tensile force resulting from the tension, are selected with reference to a density of the hydrological surface feature to locate a top surface of the deck at a selected elevation above a water line or wetland surface, allowing travel across the bridge with a load having a selected weight and selected ground press. The tension provided by the tensile support member reduces the amount of buoyancy that would otherwise be required to maintain the deck at the selected elevation above the surface of the hydrological surface feature. Correspondingly, the buoyancy provided by the deck reduces the amount of tension that would otherwise be required to maintain the deck at the selected elevation above the surface of the hydrological surface feature.

In a first aspect, the present disclosure provides a bridge and method of installing the bridge for spanning a hydrological surface feature. The bridge includes a deck spanning the hydrological surface feature, at least one tower, and a tensile support system connecting the deck with the tower under tension to provide a tensile force for supporting the deck. A density and surface area of the deck, and the tensile force provided by the tensile support system, are selected to facilitate flotation of the deck on the hydrological feature with a top surface of the deck at a selected elevation above a surface the hydrological surface feature while supporting a selected load and while the deck is supported by the tensile force.

In a further aspect, the present disclosure provides a bridge including a deck defining a length and a width perpendicular to the length, the deck extending along the length across a hydrological surface feature between a first stable terrain location and a second stable terrain location, a first tower anchored proximate the deck, and a tensile support system connected with the first tower and with the deck for supporting the deck with a tensile force. The deck has a sufficiently low deck density and a sufficiently high surface area relative to a hydrological surface feature density to rest on the hydrological surface feature with a top surface of the deck at a selected elevation above a top surface of the hydrological surface feature while supporting a selected load and while the deck is supported by the tensile force.

In some embodiments, the bridge includes a first anchor point on the first stable terrain location and a second anchor point on the second stable terrain location. The tensile support system includes a first suspension support member extending between the first anchor point, the first tower, and the second anchor point and a first hanger support member extending between the suspension support member and the deck for suspending the deck from the first suspension support member. The tensile force is transferred from the deck to the first tower and to the first and second anchor points through suspension of the deck from the first suspension support member by the first hanger support member. In some embodiments, the bridge includes a second tower anchored proximate the deck and separated from the first tower along the length, the suspension support member further extending between the first tower and the second tower, and between the second tower and the second anchor point, and wherein the tensile force is further transferred from the deck to the second tower. In some embodiments, the tensile support system includes a second suspension support member extending between the first anchor point, the first tower, and the second anchor point, the tensile support system includes a second hanger support member extending between the second suspension support member and the deck, the first suspension support member is separated from the second suspension support member across at least a portion of the width, and the tensile force is further transferred from the deck to the first tower through suspension of the deck from the second suspension support member by the second hanger support member. In some embodiments, the tensile support system includes a first plurality of hanger support members separated from each other along the length, each of the first plurality of hanger support member extending between the first suspension support member and the deck for suspending the deck from the first suspension support member, and the tensile force is further transferred from the deck to the first tower through suspension of the deck from the second suspension support member by the first plurality of hanger support members. In some embodiments, the tensile support system includes a second suspension support member extending between the first anchor point, the first tower, and the second anchor point, the first suspension support member is separated from the second suspension support member across at least a portion of the width, the tensile support system includes a second plurality of hanger support members separated from each other along the length, each of the second plurality of hanger support members extending between the second suspension support member and the deck for suspending the deck from the second suspension support member, and the tensile force is further transferred from the deck to the first tower through suspension of the deck from the second suspension support member by the second plurality of hanger support members, and the tensile force is further transferred from the deck to the first tower through suspension of the deck from the second suspension support member by the second plurality of hanger support members.

In some embodiments, the tensile support system includes a first stay support member extending between the first tower and the deck for supporting the deck, and the tensile force is transferred from the deck to the first tower through the first stay support member. In some embodiments, the bridge includes a second tower anchored proximate the deck and separated from the first tower along the length, wherein the tensile support system includes a second stay support member extending between the second tower and the deck for supporting the deck, and the tensile force is further transferred from the deck to the second tower through the second stay support member. In some embodiments, the tensile support system includes a second stay support member extending between the first tower and the deck for supporting the deck, the first stay support member separated from the second stay support member across at least a portion of the width, and the tensile force is further transferred from the deck to the first tower through the second stay support member. In some embodiments, the tensile support system includes a first plurality of stay support members separated from each other along the length, each of the first plurality of stay support members extending between the first tower and the deck for supporting the deck, and the tensile force is further transferred from the deck to the first tower through each of the first plurality of stay support members. In some embodiments, the bridge includes a second plurality of stay support members separated from each other along the length, the first plurality of stay support members separated from the second plurality of stay support members across at least a portion of the width, each of the second plurality of stay support members extending between the first tower and the deck for supporting the deck, and wherein the tensile force is further transferred from the deck to the first tower through the second plurality of stay support members.

In some embodiments, the deck includes a flow passage defined through the deck for facilitating flow of fluid and suspended components of the hydrological surface feature through the deck. In some embodiments, the flow passage extends through the deck along the width.

In some embodiments, the bridge includes a flow passage defined along the length for facilitating flow of fluids along the length between the first and second stable terrain locations. In some embodiments, the flow passage is defined within the deck. In some embodiments, the flow passage is defined within a conduit extending along the length and connected with the deck. In some embodiments, the flow passage is defined within a pair of conduits extending along the length and connected with the deck, the pair of conduits separated across from each other by at least a portion of the width.

In some embodiments, the deck includes a support matrix for retaining ballast and a surface portion secured on top of the support matrix. In some embodiments, the support matrix includes a net and a load-support material received within the net for retaining the ballast. In some embodiments, the surface portion includes a surface material on top of the support matrix and a layer of material at grade on top of the surface material.

In some embodiments, the bridge includes a sidewall extending along at least a portion of the length at a height of the deck crossing a surface of the hydrological surface feature when the top surface of the deck is at the selected elevation, the sidewall having an exterior angle to facilitate urging the deck out of the hydrological surface feature, and mitigating damage to the deck, upon freezing of the hydrological surface feature.

In some embodiments, the deck includes a rounded bottom extending along at least a portion of the length for stabilizing the bridge.

In some embodiments, the deck includes a keel extending along at least a portion of the length for breaking a surface tension of the hydrological surface feature when the deck is moved into or out of the hydrological surface feature.

In some embodiments, the first tower is anchored within the hydrological surface feature.

In some embodiments, the first tower is anchored within the first stable terrain location.

In some embodiments, the bridge includes a first anchor point on the first stable terrain location and a second anchor point on the second stable terrain location. In some embodiments, at least one of the first anchor point and the second anchor point includes a foundation in at least one of the first stable terrain location and the second stable terrain location. In some embodiments, the deck is anchored to at least one of the first anchor point and the second anchor point. In some embodiments, the tensile support system is anchored to at least one of the first anchor point and the second anchor point. In some embodiments, the first tower is anchored in the first anchor point.

In some embodiments, the width includes a major width extending along a first portion of the length and a minor width extending along a second portion of the length for facilitating greater buoyant support of the deck along the first portion of the length. In some embodiments, the width includes the major width extending along a third portion of the length, and the second portion of the length is intermediate the first portion of the length and third portion of the length. In some embodiments, the width includes the minor width extending along a third portion of the length, and the first portion of the length is intermediate the second portion of the length and third portion of the length.

In a further aspect, the present disclosure provides a method of assembling a bridge across a hydrological surface feature between a first stable terrain location and a second stable terrain location. The method includes providing a deck defining a length and a width perpendicular to the length, extending the deck across the hydrological surface feature along the length between the first stable terrain location and the second stable terrain location, anchoring a first tower proximate the deck, and connecting a tensile support system with the first tower and with the deck for supporting the deck with a tensile force. The deck has a sufficiently low deck density and a sufficiently high surface area relative to a hydrological surface feature density to rest on the hydrological surface feature with a top surface of the deck at a selected elevation above a top surface of the hydrological surface feature while supporting a selected load and while the deck is supported by the tensile force.

In some embodiments, connecting the tensile support system with the first tower and with the deck includes providing a first anchor point on the first stable terrain location, connecting a first suspension support member with the first tower and with the first anchor point, and connecting a first hanger support member with the first suspension support member and with the deck for suspending the deck from the first suspension support member to transfer the tensile force from the deck to the first tower and to the first anchor point through suspension of the deck from the first suspension support member by the hanger support member. In some embodiments, the method includes providing a second anchor point on the second stable terrain location, anchoring a second tower proximate the deck and separated from the first tower along the length, and connecting the first suspension support member with the second tower and with the second anchor point, the first suspension support member extending between the first tower and the second tower, and between the second tower and the second anchor point to transfer the tensile force from the deck to the second tower and to the second anchor point through suspension of the deck from the first suspension support member by the hanger support member. In some embodiments, providing the first and second anchor points on the first stable terrain location and the second stable terrain location includes setting foundations at the first stable terrain location and at the second stable terrain location.

In some embodiments, connecting the tensile support system with the first tower and with the deck includes connecting a second suspension support member with the first anchor point, the first tower, and the second anchor point, the first suspension support member being separated from the second suspension support member across at least a portion of the width, and connecting a second hanger support member with the second suspension support member and with the deck for suspending the deck from the second suspension support member to transfer the tensile force from the deck to the first tower and to the first anchor point through suspension of the deck from the second suspension support member by the second hanger support member. In some embodiments, connecting the tensile support system with the first tower and with the deck includes connecting a first plurality of hanger support members with the first suspension support member and with the deck for suspending the deck from the first suspension support member to transfer the tensile force from the deck to the first tower and to the first anchor point through suspension of the deck from the first suspension support member by the first plurality of hanger support members, each of the first plurality of hanger support members separated from each other along the length. In some embodiments, connecting the tensile support system with the first tower and with the deck includes connecting a second suspension support member with the first anchor point, the first tower, and the second anchor point, the first suspension support member being separated from the second suspension support member across at least a portion of the width, connecting a second hanger support member with the second suspension support member and with the deck for suspending the deck from the second suspension support member, and connecting a second plurality of hanger support members with the second suspension support member and with the deck for suspending the deck from the second suspension support member to transfer the tensile force from the deck to the first tower and to the first anchor point through suspension of the deck from the second suspension support member by the second plurality of hanger support members, each of the second plurality of hanger support members separated from each other along the length.

In some embodiments, connecting the tensile support system with the first tower and with the deck includes connecting a first stay support member with the first tower and with the deck for supporting the deck, and the tensile force is transferred from the deck to the first tower through the first stay support member. In some embodiments, the method includes anchoring a second tower proximate the deck, and wherein connecting the tensile support system with the deck includes connecting a second stay support member with the second tower and with the deck for supporting the deck, and the tensile force is further transferred from the deck to the second tower through the second stay support member. In some embodiments, connecting the tensile support system with the first tower includes connecting a second stay support member with the first tower and with the deck for supporting the deck, the first stay support member separated from the second stay support member across at least a portion of the width, and the tensile force is further transferred from the deck to the first tower through the second stay support member. In some embodiments, connecting the tensile support system with the first tower includes connecting a first plurality of stay support members separated from each other along the length, each of the first plurality of stay support members extending between the first tower and the deck for supporting the deck, and the tensile force is further transferred from the deck to the first tower through each of the first plurality of stay support members. In some embodiments, connecting the tensile support system with the first tower includes connecting a second plurality of stay support members with the first tower and with the deck for supporting the deck, the first plurality of stay support members separated from the second plurality of stay support members across at least a portion of the width, and the tensile force is further transferred from the deck to the first tower through the second plurality of stay support members.

In some embodiments, providing the deck includes securing a support matrix for retaining ballast to each of first and second stable terrain locations to extend between the anchor points, loading the support matrix with ballast, and securing a surface portion on top of the support matrix. In some embodiments, securing the surface portion on top of the support matrix includes securing a support material on top of the support matrix and providing a deck surface material at grade on top of the surface material.

In some embodiments, anchoring the first tower proximate the deck includes anchoring the first tower in the hydrological surface feature.

In some embodiments, anchoring the first tower proximate the deck includes anchoring the first tower in the first stable terrain location.

In some embodiments, the hydrological surface feature includes a first hydrological surface feature portion and a second hydrological surface feature portion, the first hydrological surface feature portion having a first density which is greater than a second density of the second hydrological surface feature portion, the first hydrological surface feature portion providing greater buoyant support to the deck than the second hydrological surface feature portion, the width includes a major width extending along a first deck portion of the length and a minor width extending along a second deck portion of the length for facilitating greater buoyant support of the deck along the first deck portion, and extending the deck across the hydrological surface feature along the length between the first stable terrain location and the second stable terrain location includes locating the first deck portion over the first hydrological surface feature portion and locating the second deck portion over the second hydrological surface feature portion. In some embodiments, the hydrological surface feature includes a third hydrological surface feature portion having a third density comparable to the first density, and the second hydrological surface feature portion is intermediate the first hydrological surface feature portion and the third hydrological surface feature portion, the width includes the major width extending along a third portion of the length, and the second portion of the length is intermediate the first portion of the length and third portion of the length, and extending the deck across the hydrological surface feature along the length between the first stable terrain location and the second stable terrain location includes locating the third deck portion over the third hydrological surface feature portion. In some embodiments, the second deck portion extends across the second hydrological surface feature portion elevated above a surface of the second hydrological surface feature portion, and the deck rests on the hydrological surface feature along the first hydrological surface feature portion and the third hydrological surface feature portion.

In some embodiments, the hydrological surface feature comprises a first hydrological surface feature portion and a second hydrological surface feature portion, the first hydrological surface feature portion having a first density which is greater than a second density of the second hydrological surface feature portion, the first hydrological surface feature portion providing greater buoyant support to the deck than the second hydrological surface feature portion, the width comprises a minor width extending along a first deck portion of the length and a major width extending along a second deck portion of the length for facilitating greater buoyant support of the deck along the first deck portion, and extending the deck across the hydrological surface feature along the length between the first stable terrain location and the second stable terrain location comprises locating the first deck portion over the first hydrological surface feature portion and locating the second deck portion over the second hydrological surface feature portion. In some embodiments, the hydrological surface feature includes a third hydrological surface feature portion having a third density comparable to the second density, and the first hydrological surface feature portion is intermediate the second hydrological surface feature portion and the third hydrological surface feature portion, the width includes the major width extending along a third portion of the length, and the first portion of the length is intermediate the second portion of the length and third portion of the length, and extending the deck across the hydrological surface feature along the length between the first stable terrain location and the second stable terrain location further comprises locating the third deck portion over the third hydrological surface feature portion.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached figures, in which features sharing reference numerals with a common final two digits of a reference numeral correspond to similar features across multiple figures (e.g. the deck 20, 120, 220, 320, 420, 520, 620, 720, 820, 920, 1020, 1120, 1220, 1320, 1420, 1520, 1620, etc.).

DETAILED DESCRIPTION

Generally, the present disclosure provides a bridge and method of erecting the bridge for providing access across water, wetlands, or unstable terrain similar to wetlands. The bridge may be similar in surface area to a conventional bridge across two points with a large length and a short width, or similar in surface area to an access mat with a greater width relative to the length.

The bridge disclosed herein leverages a combination of buoyancy and tension in a flexible support member (e.g. cable, rope, chain, wire, wire rope, lanyard, synthetic rope, or wire-rope mesh, etc., whether knotted, ferruled, or otherwise prepared, etc.) to support a load having a selected weight and ground press over a hydrological surface feature located between two stable terrain locations. One or more towers are anchored into the hydrological surface feature, the stable terrain locations, or both. A buoyant deck extending between the stable terrain locations is floated on the hydrological surface feature. The deck is also secured to each of the one or more towers by a tensile support system which includes the flexible support member (e.g. with cables as a flexible support member, the tensile support system would be a cable system, with ropes as a flexible support member, the tensile support system would be a rope system, etc.). The tensile support system extends from the one or more towers down to the deck and is in tension to support the deck with a tensile force.

The tensile force reduces the amount of buoyant force required to support the selected load at a selected elevation of the deck above a top surface of the hydrological surface feature (above the water line or wetland surface) than would otherwise be required without the tensile force. Similarly, the buoyant force reduces the amount of tensile force that would otherwise be required to support the deck and the selected load without the buoyant force. Applying both tensile and buoyant force to support the deck provides at least two alternative options for optimizing a particular bridge and may provide greater flexibility in optimizing the particular bridge relative to application of only one of these approaches to supporting a bridge deck.

Buoyant Suspension Bridge

Figure 1:
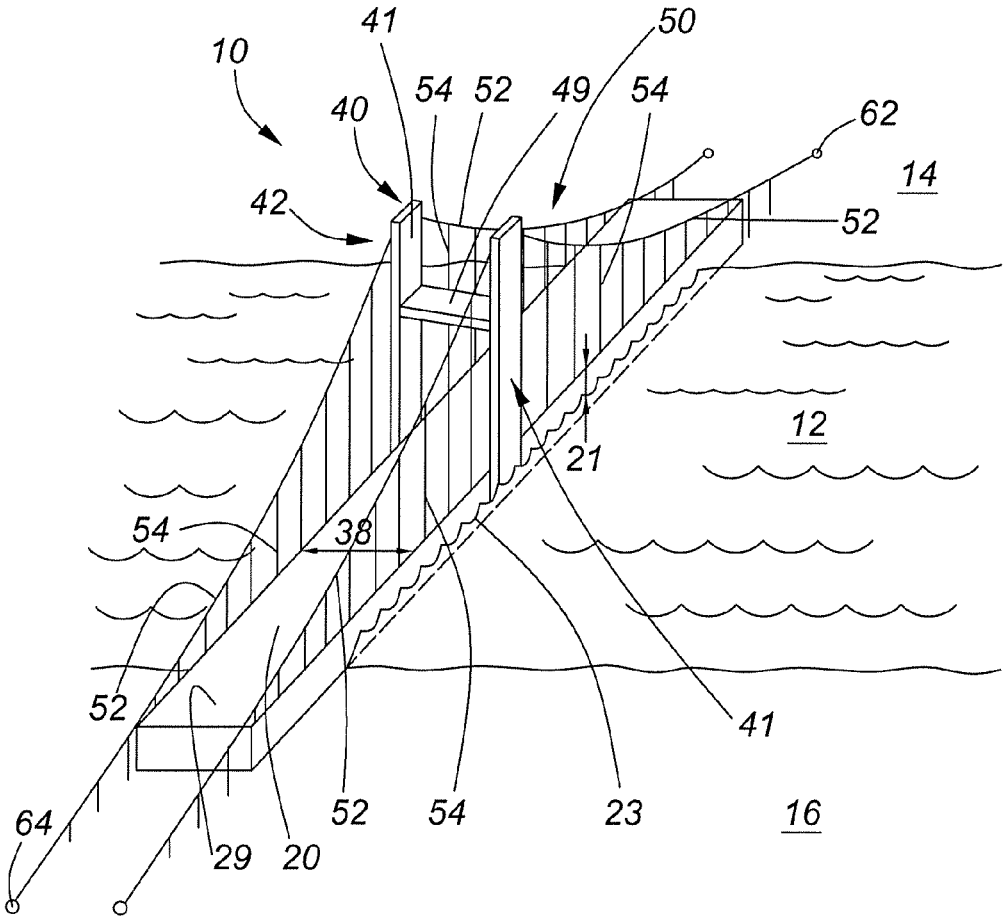
FIG. 1 is a perspective schematic of a one-tower suspension bridge crossing a hydrological surface feature.
Figure 2:
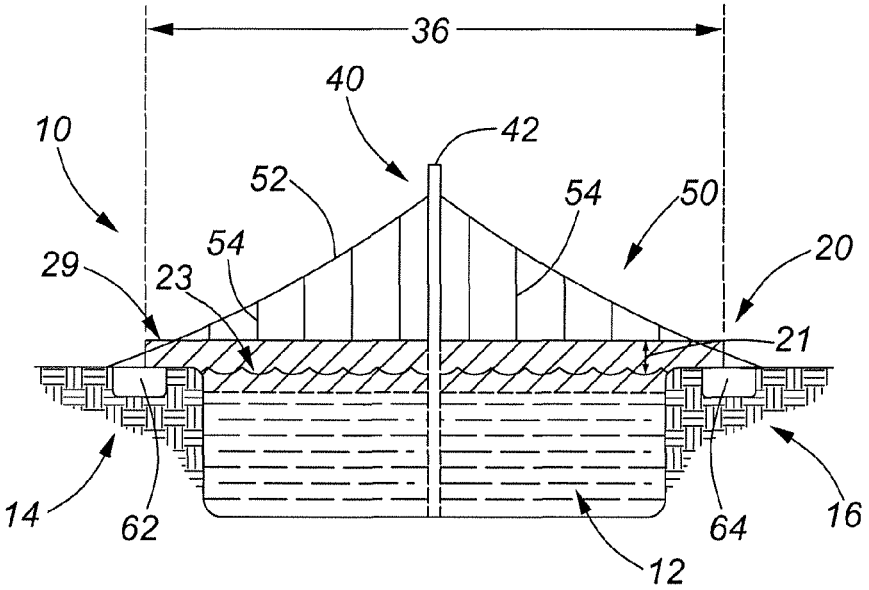
FIG. 2 is a cross-sectional schematic of the bridge of FIG. 1.

FIGS. 1 and 2 show a bridge 10 extending over a hydrological surface feature 12 between a first stable terrain location 14 and a second stable terrain location 16. The hydrological surface feature 12 may include bodies of water, wetlands (e.g. marsh, swamp, muskeg, peat peatland, bog, bogland, fen, etc.), or both. Where the hydrological surface feature 12 is a water body, it is clearly unsuitable for travel by vehicles or pedestrians. Where the hydrological surface feature 12 is wetlands, it is unsuitable for direct travel by vehicles or pedestrians because of a high moisture content and a correspondingly unstable and yielding surface. In addition, the hydrological surface feature 12 may include ecosystems which would ideally be disturbed as little as possible, providing additional disincentive to travelling directly over the hydrological surface feature 12 even when economically feasible to do so.

The bridge 10 includes a deck 20 resting on the surface of the hydrological surface feature 12 and supported by tensile force from a tower system 40 and a tensile support system 50. The deck 20 extends along a length 36 between the first stable terrain location 14 and to the second stable terrain location 16. The deck 20 extends along a width 38 perpendicular to the length 36. The tensile support system 50, the deck 20, or both, may be secured to the first stable terrain location 14 and to the second stable terrain location 16. The first stable terrain location 14 may include a first anchor point 62 and the second stable terrain location 16 may include a second anchor point 64. The deck 20 may be a solid body deck (e.g. prepared from high-strength plastics, fiberglass, fiberglass-reinforced wood, cut wood, logs, etc.). Some variations of the deck 20 are described below.

The tower system 40 includes a suspension tower 42 anchored within the hydrological surface feature 12. The tensile support system 50 includes a pair of suspension support members 52 (e.g. a suspension cable, suspension rope, etc.) extending between the suspension tower 42 and the first anchor point 62, and between the suspension tower 42 and the second anchor point 64. A plurality of hanger support members 54 (e.g. a hanger cable, hanger rope, solid-body rigid hanger, etc.) extend between the suspension support members 52 and the deck 20 for suspending the deck 20 from the suspension support members 52.

The suspension tower 42 includes two pillars 41 connected a crossbeam 49. The pillars 41 are separated from each other across the width 38. Each of the pillars 41 provides a connection point for one of the suspension support members 52. Correspondingly, the two suspension support members 52 are located across the width 38 from each other. In another example of the bridge 10, the crossbeam 49 could be absent, and each of the two pillars 41 would serve as a separate suspension tower 42 (not shown).

The tensile support system 50 includes a pair of suspension support members 52 separated from each other across the width 38. However, the bridge 10 could include any suitable combination of individual suspension support members. In one example of the bridge 10, a single suspension support member would extend along the length 36 at approximately a midpoint along the width 38 (not shown). This approach may have particular applicability in lower-load applications of the bridge 10, such as pedestrian applications. In another example of the bridge 10, the suspension support members 52 could be separated from each other by only a portion of the width 38. In another example of the bridge 10, a first pair of suspension support members would extend between the suspension tower 42 and the first anchor point 62, while a second pair of suspension support members would extend between the suspension tower 42 and the second anchor point 64, each pair of suspension support members separated from each other across at least a portion of the width 38. Regardless of there being two separate pairs of suspension support members for each of the two separate anchor points 62, 64, the first and second pairs of suspension support members of this example would together function as the pair of suspension support members 52.

The density, height, and surface area of the deck 20, and the tensile force resulting from the tensile support system 50, are selected to locate a top surface 29 of the deck 20 at an elevation 21 above a surface 23 of the hydrological surface feature 12 when the deck 20 is supporting a load having a selected weight and ground press. The elevation 21 is sufficient to allow safe travel across the bridge 10 (e.g. about 50 cm for some vehicular applications, about 15 cm for some pedestrian applications, etc.). The elevation 21 is less than a height of the deck 20 such that the deck 20 rests within the hydrological surface feature 12 and is buoyantly supported by the hydrological surface feature 12.

The combination of the density, height, and surface area of the deck 20, the tensile force resulting from the tensile support system 50, and buoyant support of the hydrological surface feature 12 allow the bridge 10 to support the selected weight and ground press while maintaining the elevation 21. Where the bridge 10 is for vehicular use, the expected weight may be in the range of about 20 tons. Where the bridge 10 is intended for heavy equipment or other vehicular traffic, the surface area may be chosen such that the width 38 of the deck 20 is between about 20 m and about 40 m. Where the bridge 10 is intended for pedestrian or bicycle traffic, the surface area may be chosen such that the width 38 of the deck 20 is between about 1 m and about 5 m.

The deck 20 floats on the fluid surface 23 of the hydrological surface feature 12 because the density, surface area, and weight of the deck 20 are selected with reference to the density of the hydrological surface feature 12 to facilitate floating while bearing the selected weight and ground press, and while supported by the tensile force provided by the tensile support system 50, according to Equation 1:

$$\frac{\rho\ (\text{deck})}{\rho\ (\text{fluid})} = \frac{\text{weight (deck)}}{\text{weight (displaced fluid)}} \qquad \text{(Eq. 1)}$$

The density values (ρ) of the deck 20 and the hydrological surface feature 12 will be constant for a given application of the bridge 10 (with water bodies having a lower density than wetlands). The actual weight of the deck 20 will also be constant. However, by providing the tensile force to the deck 20, the weight of the deck 20 applied to the hydrological surface feature 12 will be lowered and the weight of the displaced fluid in Eq. 1 will be correspondingly lowered, meaning that less fluid is displaced and the deck 20 will not sink as deeply into the hydrological surface feature 12 as would be the case without the tensile force.

The tensile force provided by the tensile support system 50 reduces the amount of buoyancy required to maintain the deck 20 at the elevation 21 above the surface 23 of the hydrological surface feature 12. Similarly, the buoyancy of the deck 20 reduces the amount of tensile force required to maintain the deck 20 at the elevation 21 above the surface of the hydrological surface feature 12. The combination of buoyancy and tensile strength may lower the material strength and other engineering requirements (and associated costs) which would be required of materials used for a bridge relying on either buoyancy or tension alone to span the hydrological surface feature 12.

Figure 4:
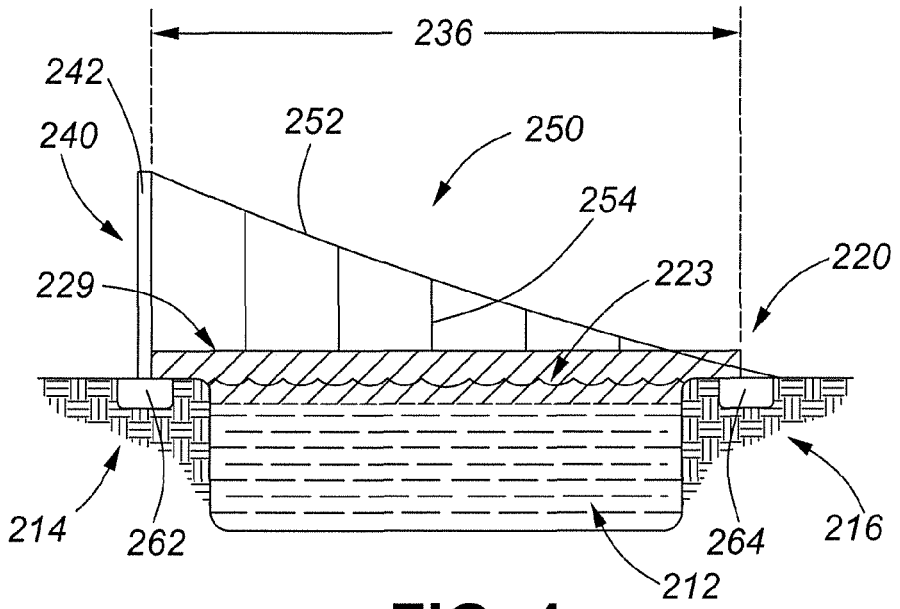
FIG. 4 is a cross-sectional schematic of a one-tower suspension bridge crossing a hydrological surface feature.
Figure 5:
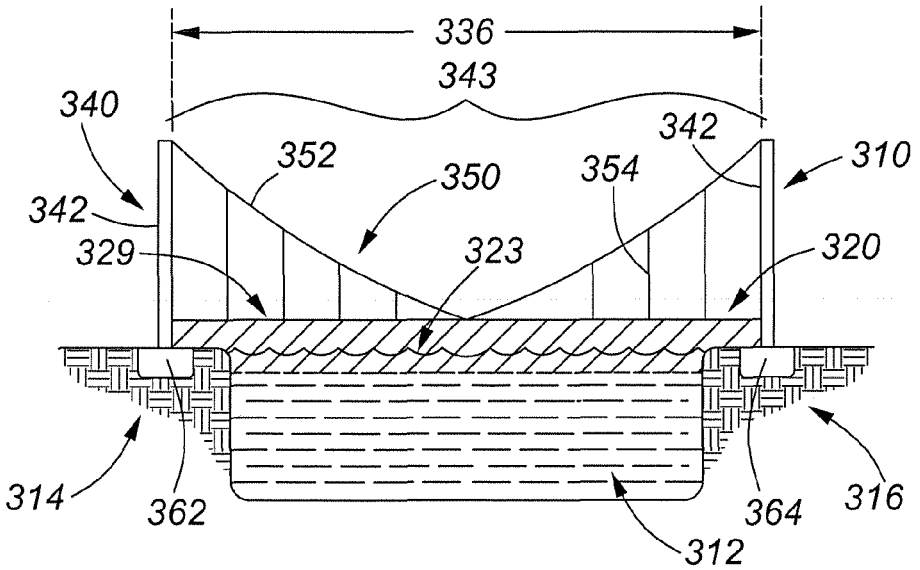
FIG. 5 is a cross-sectional schematic of a two-tower suspension bridge crossing a hydrological surface feature.

The bridge 10 is a suspension bridge which includes a single suspension tower—the suspension tower 42, which is anchored in the hydrological surface feature 12. Depending on the length, purpose, budget, and any aesthetic consideration of a given bridge as disclosed herein, the number and location of towers making up the tower system may be varied, examples of which are shown in FIGS. 3 to 5.

Figure 3:
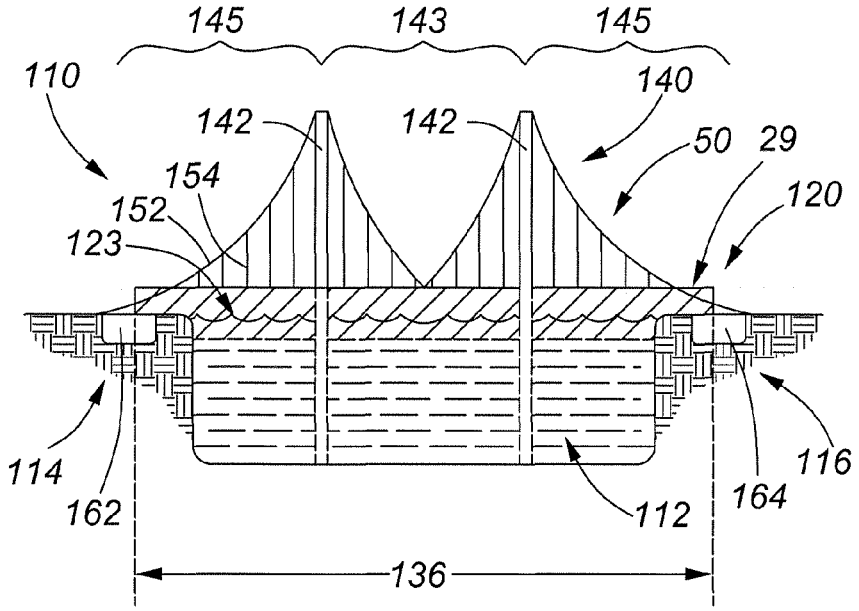
FIG. 3 is a cross-sectional schematic of a two-tower suspension bridge crossing a hydrological surface feature.

FIG. 3 is a bridge 110 having two suspension towers 142, each of which are anchored in the hydrological surface feature 112. Using the two suspension towers 142 in place of a single suspension tower may facilitate supporting a longer deck 120, using shorter suspension towers 142, or affect other design considerations. The two suspension towers 142 define a center span 143 and two side spans 145.

Similarly to the tower system 40 of FIGS. 1 and 2, the suspension towers 142 may each include a pair of pillars connected by a crossbeam and separated across at least a portion of the width of the deck 120 from each other. The width of the deck 120 is analogous to the width 38 shown in FIG. 1 for the deck 20. In another example of the bridge 110, each of the suspension towers 42 could include a pair of separate suspension towers located across at least a portion of the width of the deck 120.

Similarly to the suspension support member 52 of FIGS. 1 and 2, the pair of suspension support members 152 would typically be positioned across at least a portion of the width of the deck 120 from each other. Other examples of the tensile support system 150 analogous to those described in relation to FIGS. 1 and 2 would also apply to the bridge 110. In one such example of the bridge 110, a single suspension support member would extend along the length 136 at approximately a midpoint along the width of the deck 120. In a further such example of the bridge 110, the suspension support members 152 include multiple pairs of suspension support members, with one pair of suspension support members for each of the two side spans 145, and an additional pair or two pairs of suspension support members for the center span 143.

Using the two suspension towers 142 rather than the single suspension tower 42 of the bridge 10 allows each of the two suspension towers 142 to bear a portion of the tensile force of the tensile support system 150, rather than the single suspension tower 42 bearing all of the tensile force, which effectively reduces the material requirements both for the suspension towers 142 themselves and for a foundation or other anchoring point of the suspension towers 142. The bridge 110 also provides a potential advantage, relative to the bridge 10, of the suspension towers 142 being located at points in the hydrological surface feature 112 closer to the stable terrain locations 114, 116, which likely facilitates installation of the suspension towers 142, particularly where the hydrological surface feature 112 has a greater depth.

FIG. 4 is a bridge 210 having a single suspension tower 242 anchored in the first stable terrain location 214 at the first anchor point 262. Alternatively, the suspension tower 242 could be anchored in the first stable terrain location 214 apart from the first anchor point 262 (not shown). The suspension support member 252 is shown extending to the second anchor point 264 and not extending in the other direction deeper into the first stable terrain location 214. This would place additional stress on the suspension tower 242 compared with an embodiment wherein the suspension support member 252 is also attached to the first stable terrain location 214 to mirror the connection with the second anchor point 264 (not shown). A single anchor point for the suspension support member 252 as shown would be sufficient for relatively lower-tension applications compared with a suspension support member anchored on both sides of a suspension tower (as shown in FIGS. 1 to 3). Such lower-tension applications may be present for use on a denser hydrological surface feature 212 (e.g. a very dense bog, etc.), lighter loads (e.g. for a pedestrian bridge, etc.) or similar applications with relatively little tensile force required to support the deck 220.

Locating the suspension tower 242 on the first stable terrain location 214 provides an advantage, relative to locating it in the hydrological surface feature 212, of foregoing the requirement to anchor underneath the surface of the hydrological surface feature 212. A corresponding disadvantage of locating the suspension tower 242 on the first stable terrain location 214, relative to locating it in the hydrological surface feature 212, is that less of the total tensile force which the suspension tower 242 can bear provides support to the deck 220.

FIG. 5 is a bridge 310 having two suspension towers 342, which are anchored in the first stable terrain location 314 at the first anchor point 362 and in the second stable terrain location 316 at the second anchor point 364. The bridge 310 provides the advantages and disadvantages of two suspension towers compared with one suspension tower as described above in relation to the bridge 110 as compared with the bridge 10. The bridge 310 also provides the advantages and disadvantages of locating a single suspension tower 342 on one of the two stable terrain locations 314, 316 compared with locating a single suspension tower 242 in the hydrological surface feature 212 as described above in relation to the bridge 210 as compared with the bridge 10.

Depending on the circumstances of a particular bridge installation, one of the approaches shown in FIGS. 1 to 5, or an approach with suspension towers both on the stable terrain locations and in the hydrological surface feature, or with multiple suspension towers along the length of the deck (uncommon with even larger suspension bridges due to reduced weight transfer with more towers) may be appropriate. In some cases, anchoring the suspension tower(s) within the hydrological surface feature will be impractical due to depth, current, or other factors in a remote location. In other cases, anchoring the suspension tower(s) on the stable terrain location(s) may not be an option because of existing structures or because anchoring the suspension tower(s) that far from the center point of the deck may require unacceptably tall and costly suspension tower(s). In other cases, the length of the deck will direct the design to one of these approaches—for longer decks, placing the towers in the hydrological surface feature may be more advantageous than in shorter decks.

The bridges 10, 110, 210, and 310 may be prepared with differing qualities of material and depth of installation of the tower(s) making up the tower systems 40, 140, 240, or 340 to provide a temporary or permanent bridge across the hydrological surface feature 12, 112, 212, or 312 or any terrain which may be similarly difficult to cross. The deck 20, 120, 220, or 320 may be sized as appropriate (e.g. for heavy equipment, standard road vehicles, pedestrians, to provide a thoroughfare, to provide an access mat, etc.). Any particular installation may be made such that the deck 20, 120, 220, or 320 may fail or be replaced without requiring replacement of the tower(s) within tower systems 40, 140, 240, or 340 or the anchor points 62, 64, 162, 164, 262, 264, 362, or 364. The tower systems 40, 140, 240, or 340 and the anchor points 62, 64, 162, 164, 262, 264, 362, or 364 may be reused following replacement or maintenance on the deck 20, 120, 220, or 320, tensile support system 50, 150, 250, or 350, or both.

Construction of Buoyant Suspension Bridge

The bridge 10 may be erected onsite by anchoring the suspension tower 42 in the hydrological surface feature 12. The first and second anchor points 62, 64 may be provided by pouring concrete foundations at the stable terrain locations 14, 16. The suspension tower 42 may be anchored in the hydrological surface feature 12 by driving a pile, screwing a screw pile, or otherwise introducing the suspension tower 42 into the hydrological surface feature 12. Some hydrological surface features may include permafrost, clay, or bedrock (e.g. muskeg with a depth of about 30 m and underlying permafrost, clay, or bedrock, etc.). Piles and cement anchors may be applied to such systems with underlying permafrost, clay, or bedrock.

The deck 20 is positioned on the hydrological surface feature 12 between the stable terrain locations 14, 16 and left floating on the surface 23 of the hydrological surface feature 12. The tensile support system 50 is anchored to each of the anchor points 62, 64 and to the suspension tower 42. The suspension support members 52 are connected with the anchor points 62, 64 and with the suspension tower 42. The hanger support members 54 are connected with the deck 20 and with the suspension support member 52. The suspension support member 52 is tightened to the appropriate tension to allow the hanger support members 54 to provide the tensile force to support the deck 20 where the top surface 29 is at the selected elevation 21 above the surface 23 when a selected load and ground press are on the deck 20.

When the bridge 10 is to be disassembled, the tensile support system 50 may be disconnected from the deck 20. The deck 20 may then be removed from the hydrological surface feature 12. The tensile support system 50 may also be disconnected from the tower system 40. The tensile support system 50 and the deck 20 may then be removed from the site and returned to a camp or facility for storage, maintenance, or disposal. Where the bridge is intended to remain in place for only a portion of the year or is otherwise required intermittently but regularly, the tower system 40 and the anchor points 62, 64 may remain in place for use at a later time. Removal of the deck 20 during a portion of the year when no bridge 10 is required may provide benefits in terms of conservation by eliminated any disruption of an ecosystem including the hydrological surface feature 12 which may result from the deck 20 floating in the hydrological surface feature 12.

Similar steps would be involved in erecting and disassembling the bridges 110, 210, or 310. The number and location of suspension towers would vary with the particular bridge. For the bridge 110, two suspension towers 142 would be located in the hydrogeological surface feature 112. In the bridge 210, one suspension tower 242 would be located in the first stable terrain location 214. In the bridge 310, two suspension towers 342 are located in the first and second stable terrain locations 214, 216.

Buoyant Stayed Bridge

The bridges 10, 110, 210, and 310 are each suspension bridges. In these suspension bridges, each of tensile support systems 50, 150, 250, and 350 respectively include a suspension support member 52, 152, 252, and 352 connected with hanger support members 54, 154, 254, and 354. The hanger support members 54, 154, 254, and 354 are in tension, or are solid-bodied, and suspend the decks 20, 120, 220, and 320 from the suspension support members 52, 152, 252, and 352. The tensile force may alternatively be supplied by directly connecting a tower and a deck with stay support members, examples of which are shown in FIGS. 6 to 9.

Figure 6:
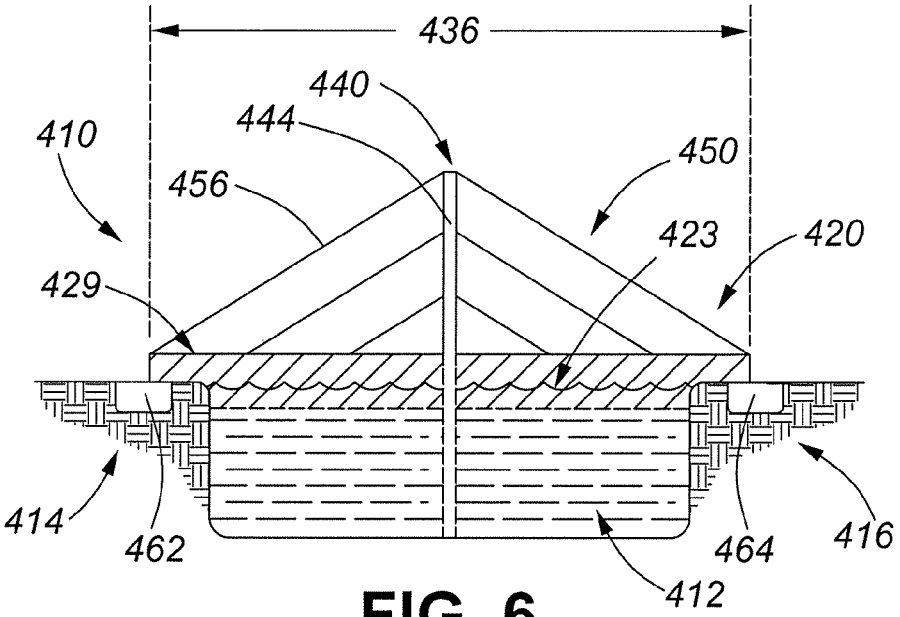
FIG. 6 is a cross-sectional schematic of a one-tower stayed bridge crossing a hydrological surface feature.

FIG. 6 is a bridge 410 in which the tower system 440 includes a stay tower 444 anchored within the hydrological surface feature 412. The tensile support system 450 includes a plurality of stay support members 456 (e.g. stay cables in a cable-stayed bridge, stay ropes in a rope-stayed bridge, etc.) extending between the stay tower 445 and the deck 420. The stay tower 444 is located approximately at a midpoint of the length 436 of the deck 420, similarly to the suspension tower 42 in the bridge 10.

Similarly to the suspension members 52 of FIGS. 1 and 2, the stay support members 456 may include any suitable combination of individual stay support members. In one example of the bridge 410, each of the stay support members 456 is a single stay support member extending along the length 436 at approximately a midpoint along a width of the deck 420 (not shown). In another example of the bridge 410, a pair of stay support members 456 are located across a width of the deck 420 from each other. Each pair of stay support members 456 extends between the deck 420 and the stay tower 444. In another example of the bridge 410, a first pair of stay support members would extend between the stay tower 444 and the first anchor point 462, while a second pair of stay support members would extend between the stay tower 444 and the second anchor point 464. Regardless of there being two separate pairs of stay support members 456 for the two separate anchor points 462,464, the first and second pairs of stay support members 456 of this example would together function as a pair of stay support members 456.

Figure 7:
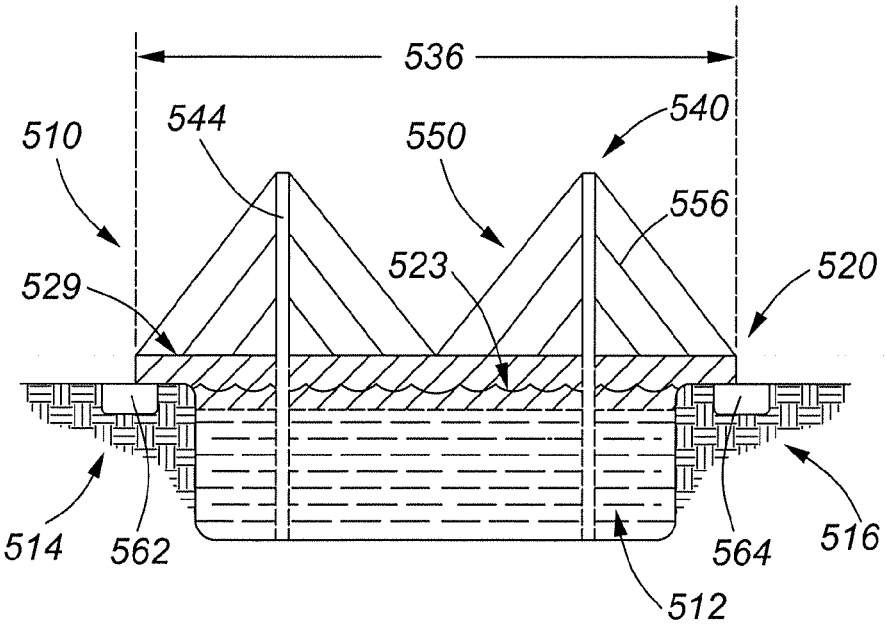
FIG. 7 is a cross-sectional schematic of a two-tower stayed bridge crossing a hydrological surface feature.

FIG. 7 is a bridge 510 in which the tower system 550 includes two stay towers 544. The stay support members 556 extend between the respective stay towers 544 and the deck 520 intermediate the respective stable terrain locations 514, 516, and between the respective stay towers 544 and the deck 520 intermediate the two stay towers 544. As described above with respect to the bridge 110 as compared with the bridge 10, this arrangement reduces the material strength requirements on the two stay towers 544 compared with the single stay tower 444, in order to support the deck 520 with a comparable amount of tensile force for a given example of the bridge 410. Similarly to the suspension support member 52 of FIGS. 1 and 2, the stay support members 556 may include multiple individual suspension support members, with similar examples to those described above in respect of the bridge 410 of FIG. 6 with respect to the features of stay cables, and of the bridge 110 of FIG. 3 with respect to the number of stay towers 544.

Figure 8:
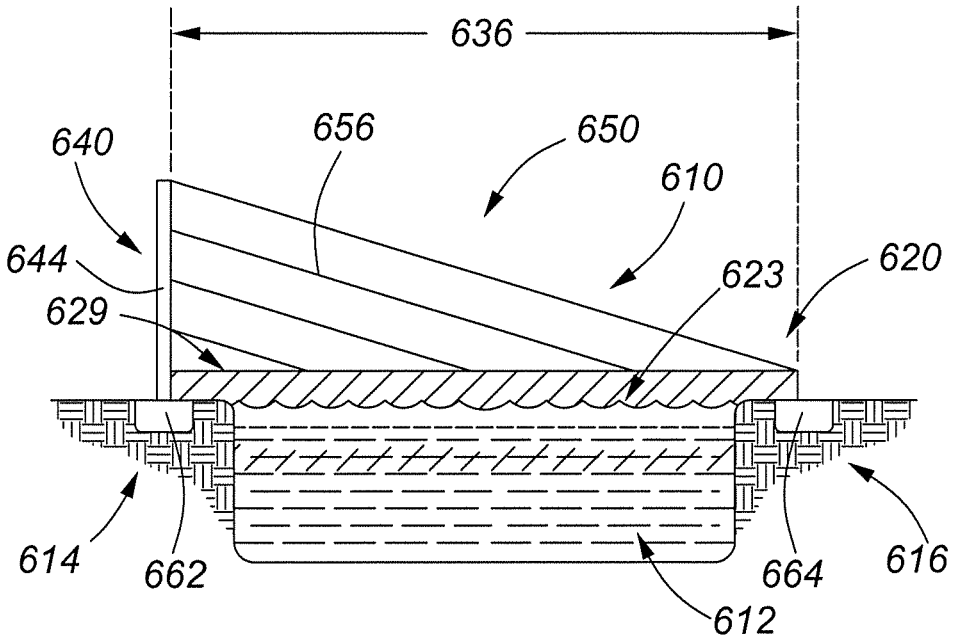
FIG. 8 is a cross-sectional schematic of a one-tower stayed bridge crossing a hydrological surface feature.

FIG. 8 is a bridge 610 in which the tower system 650 includes a single stay tower 644 on the first stable terrain location 614. Similarly to the bridge 210 compared with the bridge 10, the bridge 610 would benefit from additional stay support members extending from the stay tower 644 to the first stable terrain location 614 (not shown) to offset the resulting stress on the stay tower 644 when supporting the deck 620, particularly with higher-tension applications. Similarly, the other advantages and disadvantages of locating the stay tower 644 on the first stable terrain location 614 rather than in the hydrological surface feature 612 are also similar to the advantages and disadvantages described above in relation to the bridges 210 and 10 of FIGS. 4 and 1 to 2.

Figure 9:
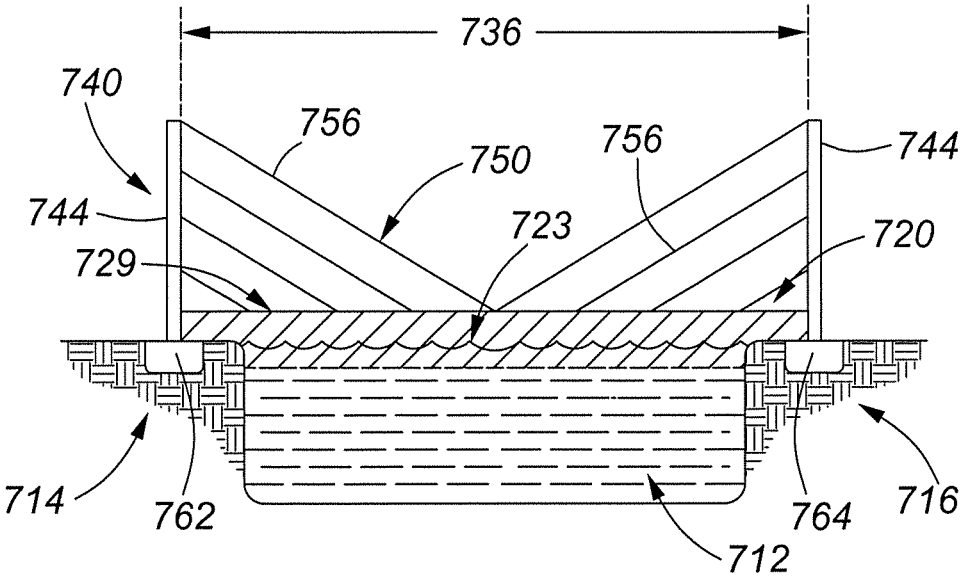
FIG. 9 is a cross-sectional schematic of a two-tower stayed bridge crossing a hydrological surface feature.

FIG. 9 is a bridge 710 in which the tower system 750 includes a pair of stay towers 744 respectively anchored in the first and second stable terrain locations 714, 716. The bridge 710 provides the advantages and disadvantages of two stay towers compared with one stay tower as described above in relation to the bridge 510 as compared with the bridge 310. The bridge 710 also provides the advantages and disadvantages of locating a single stay tower 744 on one of the two stable terrain locations 714, 716 compared with locating the single stay tower 744 in the hydrological surface feature 712 as described above in relation to the bridge 610 as compared with the bridge 410.

Generally, compared with suspension bridges, the support member-stayed bridges of FIGS. 6 to 9 may be preferable at very short lengths (e.g. about 10 m) or at very long lengths (e.g. more than 2 km, about 3 km, etc.). In addition, for very long deck lengths, multiple stay towers may be included to provide tensile support at regular intervals along the length of the deck. Installation and dismantling of the support member-stayed bridges of FIGS. 6 to 9 would largely follow the general approaches described above for the suspension bridges of FIGS. 1 to 5 with the apparent differences which arise from the differences in the respective tensile support systems. The stay support members connect the stay towers directly to the deck, in contrast with suspension support members which connect the suspension towers to the stable terrain locations, with hangers extending from the suspension support members to the deck.

Flowthrough Deck

Figure 10:
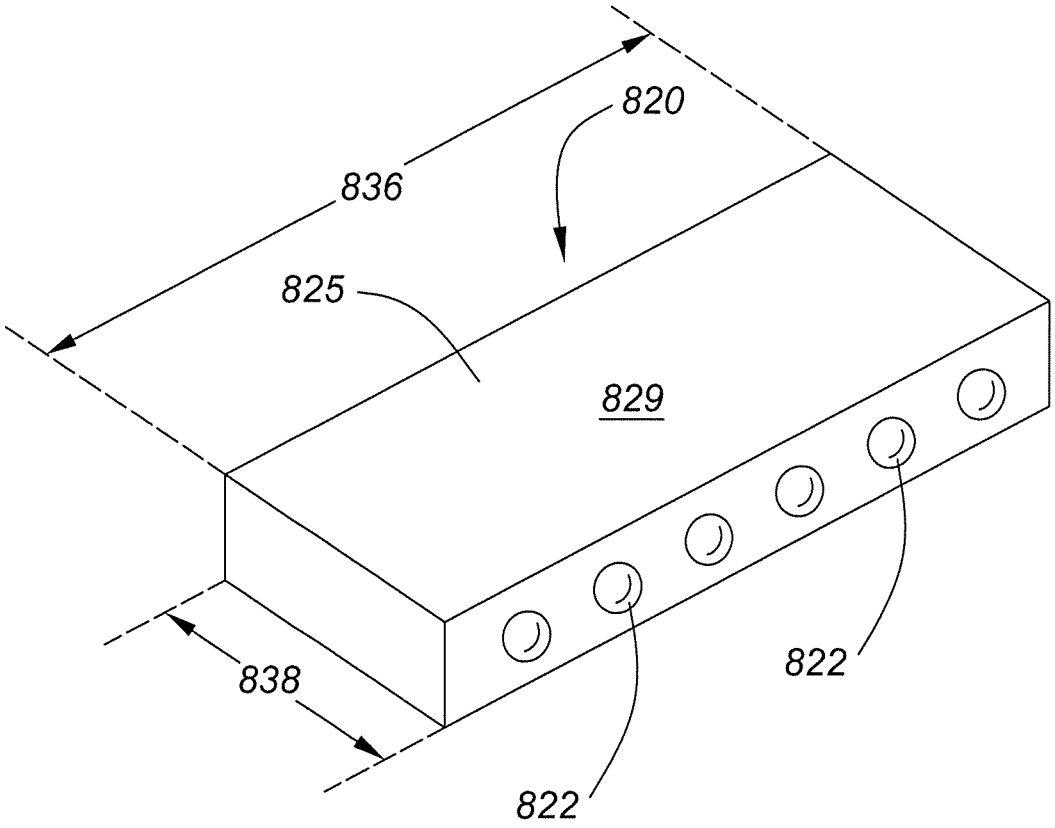
FIG. 10 is a perspective schematic of a deck including flowthrough passages.

FIG. 10 deck 820 having a body 825 with flow passages 822 through the body 825 to allow passage of fluids making up the hydrological surface feature 812. In some previous floating bridges or swamp mats used to cross wetlands, the bridges acted as dams, blocking water flow and causing environmental damage. The flow passages 822 are sized and spaced to allow fluids to pass through the flow passages 822 without compromising the ability of the deck 820 to support the selected weight and ground press while maintaining the elevation 821, reducing the environmental impact of the bridge 810. A screen or bars defining appropriately sized apertures (not shown) may be included at the mouths of the flow passages 822 to prevent beavers or other fauna from inhabiting and blocking the flow passages 822 and to mitigate clogging by debris.

Figure 11:
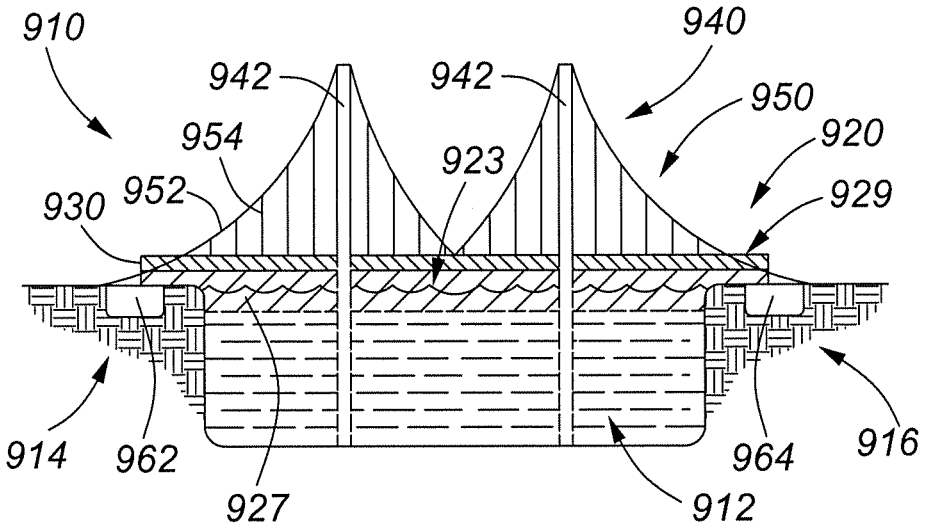
FIG. 11 is a cross-sectional schematic of a bridge including a deck with a support matrix and surface material.

FIG. 11 is a bridge 910 in which the deck 920 includes a support matrix 927 and a surface portion 930 on top of the support matrix 927. The top surface 929 is defined by the surface portion 930.

Figure 12:
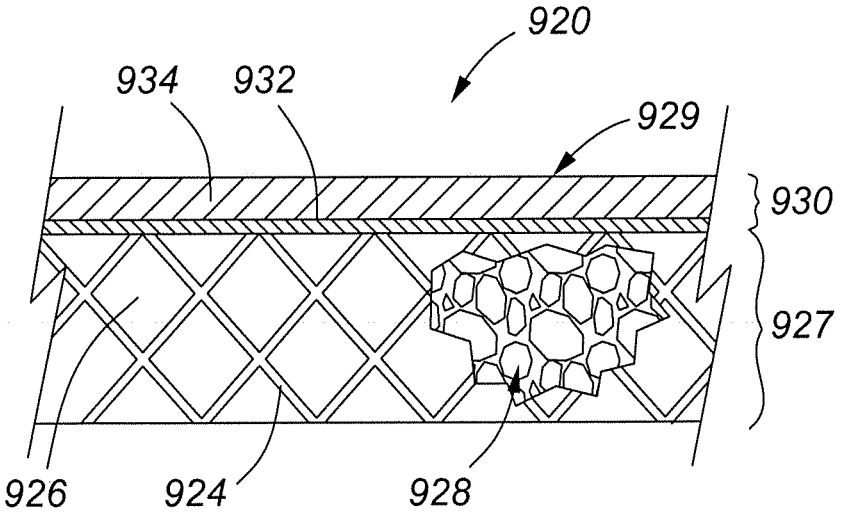
FIG. 12 is a cross-sectional schematic of the deck of FIG. 11.

FIG. 12 is a portion of a deck 920 showing details of the support matrix 927 and the surface portion 930. The support matrix 927 includes a net 924 and a support material 926 received within the net 924. A cutaway portion of the support matrix 927 shows ballast 928 (e.g. sand, gravel, limestone, lava rock or other volcanic rocks, coal, wood, peat moss, etc.) received within the net 924 and the support material 926 to provide deck stability with a sufficiently low density for the deck 920 to rest at the elevation 921. Together, the net 924 and the support material 926 define the support matrix 927 and support the ballast 928. The elevation 921 may be selected to ensure that the support matrix 927 remains below the surface of the hydrological surface feature 912. Biodegradable or otherwise environmentally-acceptable materials may be selected for the ballast 928 where the bridge 910 is intended to be removed after a set time (e.g. a set time of between about 6 months and about 5 years, etc.) by removal of the net 924 and other materials, but leaving the ballast 928 behind. Removal of the net 924 may be facilitated by reeling in the net 924 after using a temporary bridge 910 with a net 924 which is not biodegradable.

The support material 926 facilitates retention of the ballast 928 having individual pieces smaller than apertures defined by the net 924. The net 924 may be prepared from a variety of materials, often determined with reference to cost and the duration for which the bridge 910 is intended to be in service. Where the bridge 910 will be in place permanently or for a long duration, the net 924 may be advantageously prepared from steel fibers. In contrast, where the bridge 910, including the net 924 is intended to biodegrade after a selected time, the net 924 may be prepared from a biodegradable fiber. In some cases, a steel net 924 may be used and removed from the site, particularly where the hydrological surface feature 912 does not include a delicate ecosystem, as withdrawing the net 924 may result in damage and disturbance to the hydrological surface feature 912.

The support material 926 may be prepared from a variety of materials, which may also be selected with reference to cost and the duration for which the bridge 910 is required to be in service. Where the bridge 910 will be in place for a long duration, the support material 926 may be prepared from a robust and persistent material such as some geotextiles. Where the bridge 910 is intended to biodegrade after a set time, the support material 926 may be prepared from a biodegradable material (e.g. coir geotextiles prepared from coconut fiber, etc.).

The surface portion 930 includes a surface support material 932 (e.g. a geotextile, etc.) on top of the support matrix 927. A deck surface material 934 (e.g. soil, clay and sand mixture, asphalt, solid fiberboard, etc.) may be included on top of the support material 926. The deck surface material 934 may be added to provide a final grade above the hydrological surface feature 912, facilitating a smooth transition from the first and second stable terrain locations 914, 916. The elevation 921 may be selected to ensure that the entire surface portion 930 remains above the hydrological surface feature 912. The support material 932 may be waterproof to prevent wicking of water up from the hydrological surface feature 912 to the deck surface material 934. A porous design of the support matrix 927 and the presence of aggregate 926, facilitate fluid flow through the support matrix 927, similarly to the flow passages 820 of the deck 820. In addition, flow passages similar to the flow passages 820 can also be included in the support matrix 927 by providing pipe lengths within the ballast 928 (not shown), forming passages through the support matrix 927.

When erecting the bridge 910, the support matrix 927 is positioned between the stable terrain locations 914, 916 (e.g. by connection with the anchor points 962, 964, etc.). If applicable, the support material 926 may be attached to the net 924. The support matrix 927 may then be filled with the ballast 928 to provide the appropriate stability and buoyancy to the deck 920, and the net 924 may be tensioned in cases the net 924 is connected with each of the anchor points 962, 964. The surface portion 930 may then be added to the support matrix 927 to complete the deck 920. The surface support material 932 may be laid out on the support matrix 927 and the deck surface material 934 added on top of the surface support material 932.

Where the support matrix 927 is connected with the anchor points 962, 964, the suspension towers 942 may be driven to full anchoring depth after the support matrix 927 has been filled with the ballast 928 and connected with the anchor points 962, 964, to facilitate locating the surface portion 930 at the selected elevation 921. In addition, the net 924 or other component of the support matrix 927 may be tightened relative to an anchor point 962 or 964 with a winch or otherwise to provide additional tension in the net 924 or other component of the support matrix 927.

The bridge 910 is shown as a two-tower suspension bridge similar to the bridge 110. However, the deck 920 may be applied to any of the suspension or stayed bridges shown in FIGS. 1 to 9, or to any variants of such bridges.

As with the bridges shown in FIGS. 1 to 9, the deck 920 may be replaced without replacing the anchor points 962, 964, the tower system 940, or both. In addition, the support matrix 927 and the surface portion 930 will likely be simpler to remove or to reinstall than a rigid body deck. The user need only remove netting and geotextiles or similar materials, or allow these components to biodegrade. Depending on what is used and applicable regulations and the material used as the ballast 928, the ballast 928 may in some cases be left onsite.

Deck Features

FIGS. 13 to 23 show decks 1020, 1120, 1220, 1320, 1420, 1520, and 1620 which may be applied to any of the bridges disclosed herein. Each deck of FIGS. 13 to 23 are shown in a cross-sectional plan view along the length of the deck. The decks of FIGS. 13 to 23 are shown schematically as solid-body decks, similar to the deck 820 of FIG. 10. However, the features shown in the decks of FIGS. 13 to 23 could also be included in the flow-through deck 920. The tower system, tensile support system, and anchor points of a bridge with which the decks of FIGS. 13 to 23 may be applied are not shown in FIGS. 13 to 23.

Figure 13:
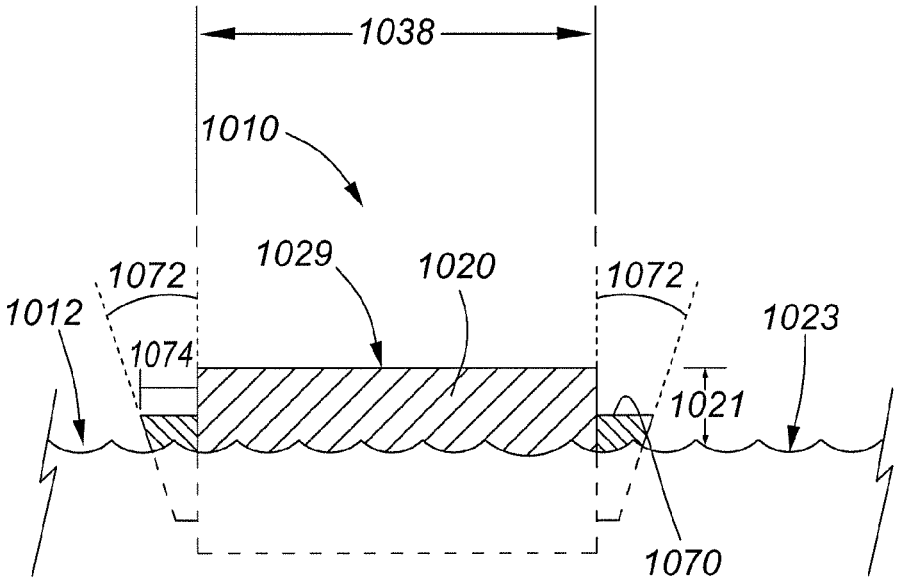
FIG. 13 is a cross-sectional schematic of a deck including a protective sidewall.

FIG. 13 is a deck 1020 which includes sidewalls 1070. The sidewalls 1070 are located on both sides of the deck 1020 at a height of the deck 1020 which spans the surface 1023 when the deck 1020 is at the elevation 1021. An exterior angle 1072 and corresponding varying thickness 1074 of the sidewall 1070 are selected such that when freezing begins at the surface 1023 and progresses downward into the hydrological surface feature 1012, the deck 1020 is urged upwards and out of the hydrological surface feature 1012, rather than being crushed. This results in the deck 1020 being at a greater elevation off the hydrological surface feature 1012 than the elevation 1021. If the bridge 1010 is to remain in use during the winter, the tensile support system (not shown in FIG. 13 but analogous to the tensile support systems 50, 150, 250, 350, 450, 550, 650, 750, 850, 950, 1550, or 1650) may be adjusted to maintain the tensile force at a greater elevation 1021.

Where the bridge 1010 is built over denser hydrological surface features 1012, such as muskeg, the bridge 1010 may be more stable when the muskeg is frozen. The bridge 1010 may also benefit from the increased bearing strength induced by freezing of the hydrological surface feature 1012, possibly including an above-ground layer of compacted snow or ice. However, in some cases, freezing may crush a deck which does not include the sidewall 1070. Depending on the design of the bridge 1010, the sidewalls 1070 may also result in the deck 1020 floating higher and with less stability than would be the case without the sidewalls 1070.

The deck 1020 which includes the sidewalls 1070 may be prepared from a solid body (e.g. the deck 820, etc.) or a body based on aggregate and a support matrix (e.g. the deck 920, etc.). The sidewalls 1070 may be prepared from any suitable material which, at the exterior angle 1072 and thickness 1074, allow the sidewalls 1070 to resist crushing forces associated with freezing at the surface 1023 and below, and emerge from the hydrological surface feature 1012 rather than crushing.

Figure 14:
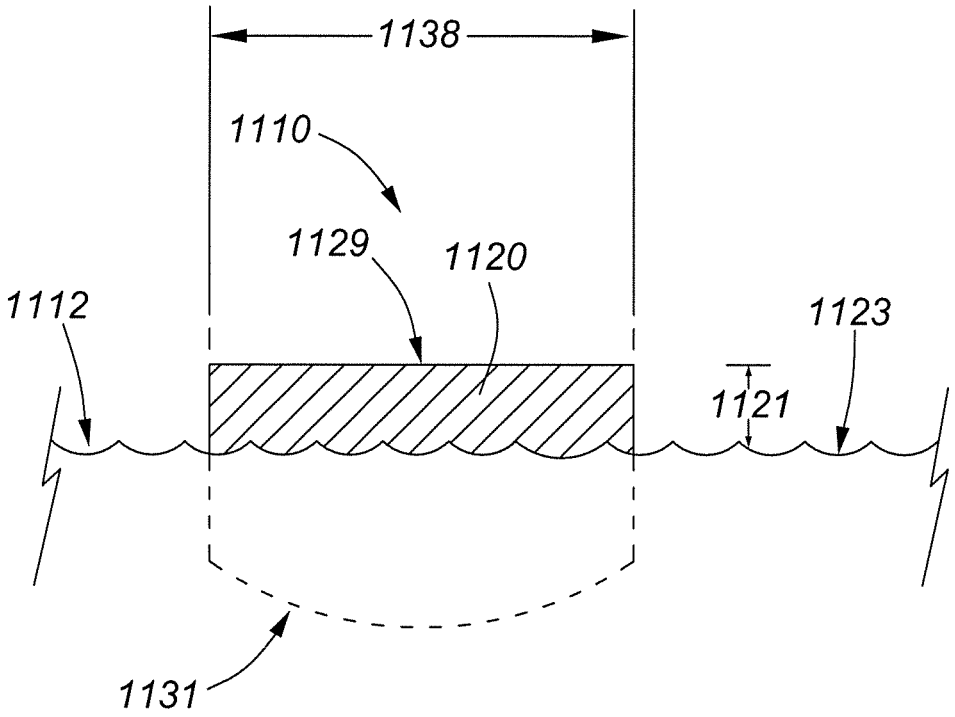
FIG. 14 is a cross-sectional schematic of a deck including a rounded bottom.

FIG. 14 is a schematic of a deck 1120 including a rounded bottom 1131. The rounded bottom 1131 rests below the surface 1123 of the hydrological surface feature 1112 when the deck 1120 is resting in the hydrological surface feature 1112 at the selected elevation 1121 above the surface 1123. The rounded bottom 1131 distributes buoyancy and ballast similarly to the bottom of a barge and stabilizes the deck 1120, and any bridge within which the deck 1120 is used, in the hydrological surface feature 1112.

Figure 15:
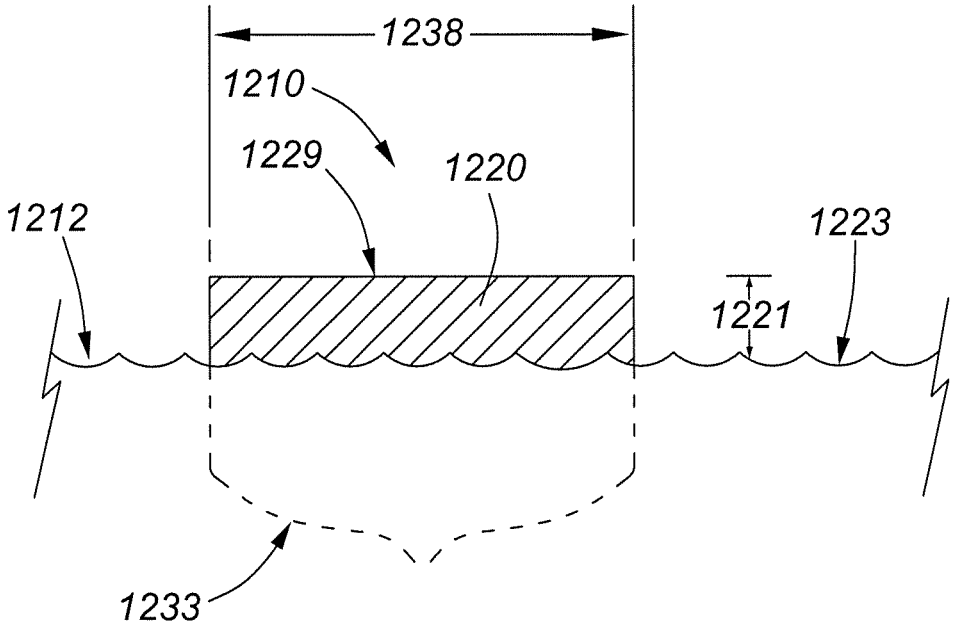
FIG. 15 is a cross-sectional schematic of a deck including a keel.

FIG. 15 is a schematic of a deck 1220 including a keel 1233. The keel 1233 rests below the surface 1223 of the hydrological surface feature 1212 when the deck 1220 is resting in the hydrological surface feature 1212 at the selected elevation 1221 above the surface 1223. The keel 1233 breaks surface tension similarly to the bottom of a ship and facilitates ingress of the deck 1220 into the hydrological surface 1212 and egress of the deck 1220 out of the hydrological surface feature 1212. This facilitates installation and dismantling of a bridge including the deck 1220.

Figure 16:
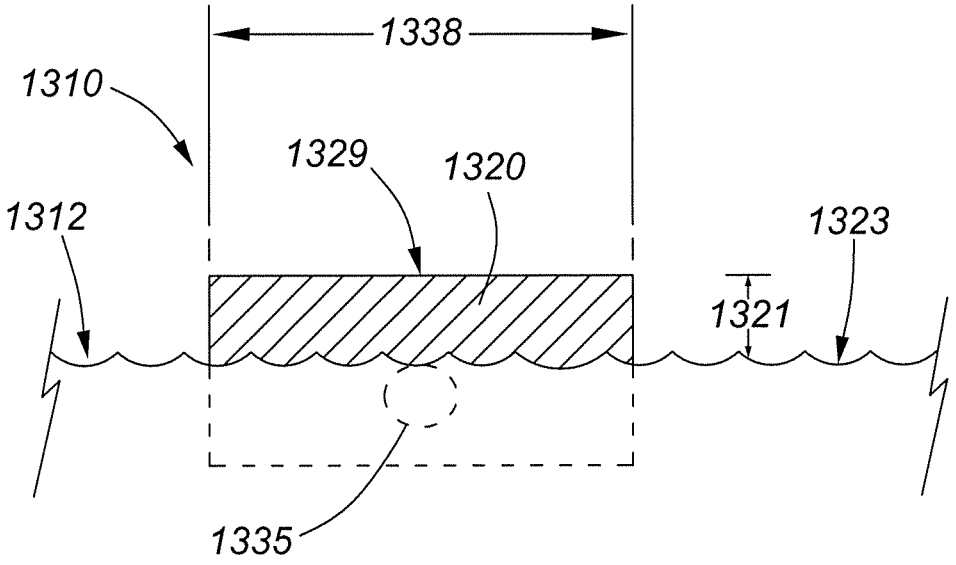
FIG. 16 is a cross-sectional schematic of a deck including a fluid transportation line extending along a length of the deck within the deck.

FIG. 16 is a schematic of a deck 1320 including a fluid transportation line 1335 defined within the deck 1320 and extending along the length of the deck 1320 (analogous to the length 36 of the deck 20) at approximately a midpoint of the width 1338. The fluid transportation line 1335 may be used to transport hydrocarbons or other fluids which are likely to have a lower density than the hydrological surface feature 1312. This would add buoyancy to the deck 1320 when the fluid transportation line 1335 is filled with hydrocarbons or other fluids with a lower density than the hydrological surface feature 1312. Previously, fluid transport lines would often be run alongside a temporary roadway or access mat. Locating the fluid transport line below the deck 1320 may provide additional buoyancy. If fluids with a greater density than the hydrological surface feature 1312 are to be transported, then the fluids may provide additional ballast rather than additional buoyancy.

Figure 17:
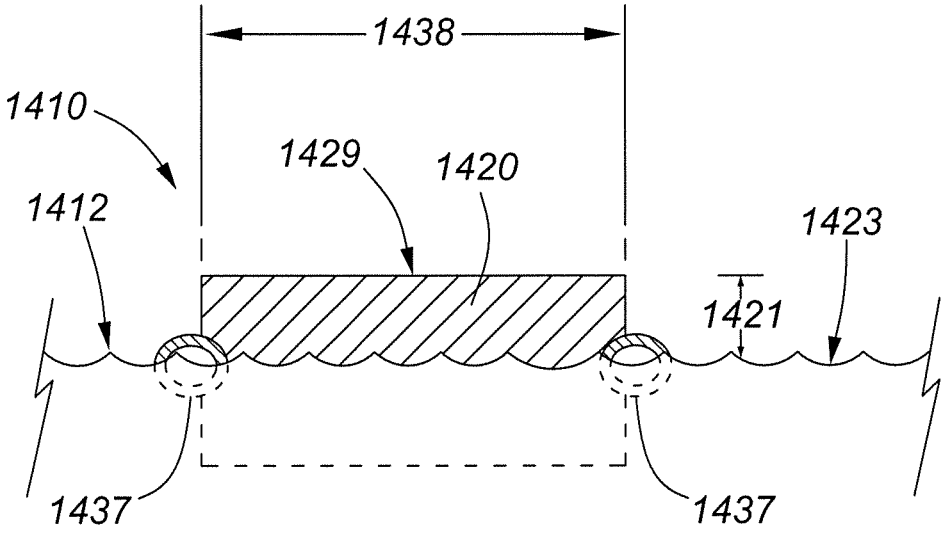
FIG. 17 is a cross-sectional schematic of a deck including a pair of fluid transportation lines extending along a length of the deck.

FIG. 17 is a schematic of a deck 1420 including a pair of fluid transportation lines 1437 extending along the length of the deck 1420. The fluid transportation lines 1437 are separated from each other by approximately the width 1438. While the fluid transport lines 1437 would function similarly to the single fluid transport line 1335, additional stability may be provided by having the buoyancy or ballast provided by the fluid transport lines 1437 spread out across the width 1438, as compared with the fluid transport line 1335. In addition, the fluid transport lines 1437 are simpler to install, service, and remove because they are located outside of the deck 1420. However, the fluid transport line 1335 is less likely to be damaged unintentionally than the exposed fluid transport lines 1437.

Figure 18:
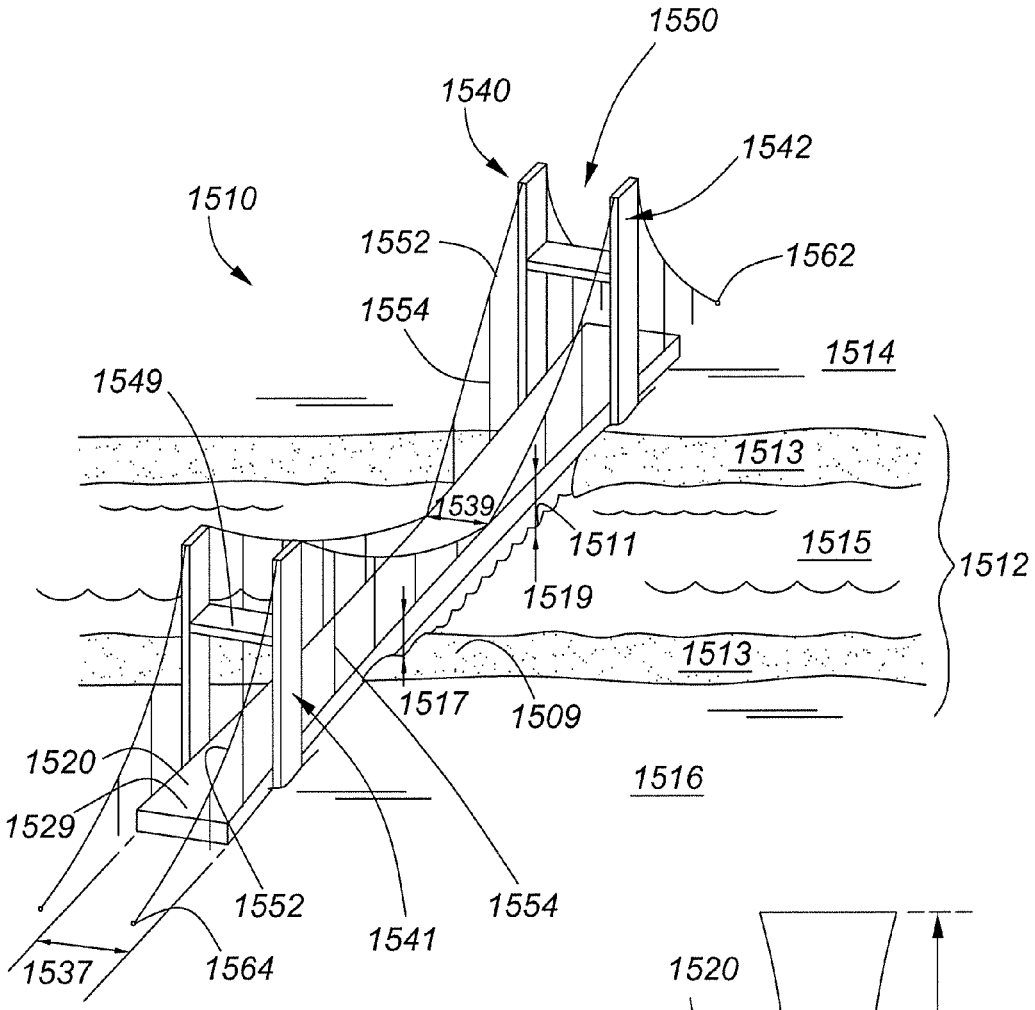
FIG. 18 is a perspective schematic of a two-tower suspension bridge crossing a hydrological surface feature.
Figure 19:
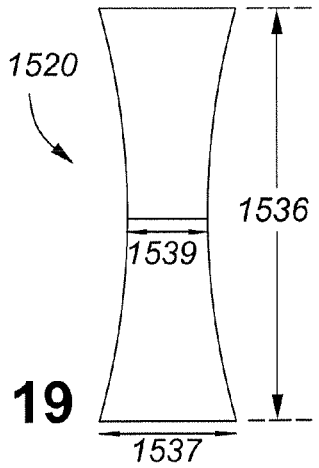
FIG. 19 is a plan view of a deck of the bridge of FIG. 18.
Figure 20:
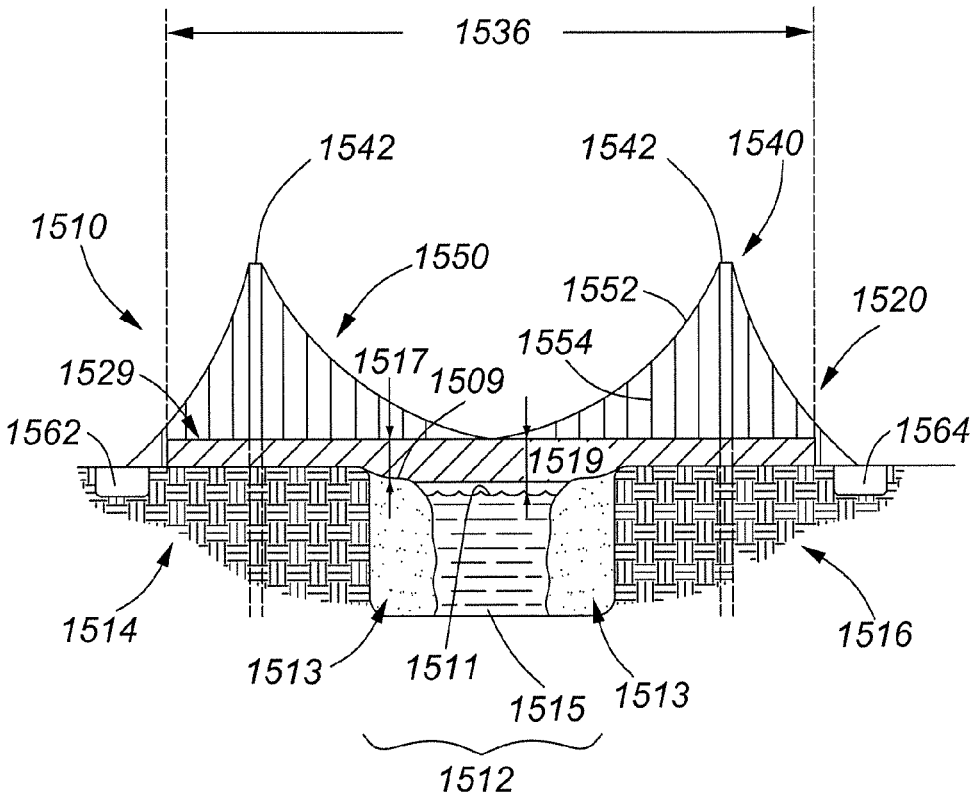
FIG. 20 is a cross-sectional schematic of the bridge of FIG. 18.

FIGS. 18 to 20 are schematics of a bridge 1510 crossing a hydrological surface feature 1512. The hydrological surface feature 1512 includes a first portion including two yielding solid portions 1513 proximate each of the first and second stable terrain locations 1514, 1516. The hydrological surface feature 1512 also includes a second portion including a fluid portion 1515 intermediate the two yielding solid portions 1513. The yielding solid portions 1513 may include wetlands (e.g. marsh, swamp, peat bog, muskeg, bogland, etc.). The fluid portion 1515 may include primarily water. The yielding solid portions 1513 have a greater density than the fluid portion 1515 and provide greater buoyant support to the deck 1520 than the fluid portion 1515. The suspension towers 1542 are located on the first and second stable terrain portions 1514, 1516.

The top surface 1529 rests at an elevation 1517 above a surface 1509 of the yielding solid portions 1513. The elevation 1517 is less than a height of the deck 1520 such that the deck 1520 rests within the yielding solid portions 1513 and is buoyantly supported by the yielding solid portions 1513.

The top surface 1529 rests at a greater elevation 1519 above a top surface 1511 of the fluid portion 1515 than the above the top surface 1513 of the yielding solid portions 1513. The elevation 1519 is greater than the height of the deck 1520 such that a bottom surface of the deck 1520 rests above the fluid portion 1515 and is not buoyantly supported by the fluid portion 1515.

The deck 1520 has a major width 1537 extending along the length 1536 over the yielding solid portions 1513 and a minor width 1539 extending along the length 1536 over the fluid portion 1515. The portion of the deck 1520 with the minor width 1539 partially overlaps the yielding solid portions 1513. The greater width of the major width 1537 relative to the minor width 1539 provides additional support to a load on the deck 1520. The additional support mitigates the reduced support over the fluid portion 1515, relative to over the yielding solid portions 1513, resulting from the lack of buoyant support over the fluid portion 1515. The deck 1520 may be constructed with different heights of the deck, from different materials, or otherwise vary, as between portions of the deck 1520 having the major width 1537 compared with portions of the deck 1520 having the minor width 1539. The lack of buoyant support along the length 1536 corresponding to the minor width 1539 allows more freedom in the design of the portion of the deck 1520 having the minor width 1539. For example, the buoyancy of the portion of the deck with the minor width 1539 would not constrain design as buoyancy would for the portion of the deck with the major width 1537.

The fluid portion 1515 has a lower top surface 1511 than the top surface 1509 of the yielding solid portions 1513 and the deck 1520 has no buoyant support along the length 1536 over the fluid portion 1515. In another example application, the bridge 1510 may be applied to a hydrological surface feature which is essentially homogenous in density, but which includes a drop-off such that a portion of the deck has a greater elevation above the surface of the hydrological surface feature than the height of the deck. In such applications, the bridge 1510, with the major width 1537 and the minor width 1539, would provide a similar advantage to use on the hydrological surface feature 1512 as shown in FIG. 18—additional buoyant support for the deck 1520 provided by the major width 1537 makes up for reduced or absent buoyant support compared with the portions of the deck 1520 having the minor width 1539. In another example application where the hydrological surface feature includes multiple fluid portions interspersed with yielding solid portions, the deck could include alternating portions having the major width or the minor width to accommodate the particular hydrological surface feature, depending on where the hydrological surface feature includes areas with less buoyant support, whether because of changes in density, in height, or both.

The ratio between the major width 1537 and the minor width 1539 would depend on the respective lengths of the portion of the deck 1520 having the major width 1537 and the portion of the deck 1520 having the minor width 1539. In some cases, the major width 1537 may be about twice the width of the minor width 1539.

The bridge 1510 is a suspension bridge with two suspension towers 1542 anchored in the stable terrain portions 1514, 1516. Alternative suspension bridges including tower systems similar to the tower systems 40, 140, or 240, or tensile support systems 50, 150, or 250 may also include the deck 1520 (not shown). Similarly, a stayed bridge including the features of the deck 1520 and the features of the tensile support systems 440, 540, 640, or 740, could also be prepared (not shown).

Figure 21:
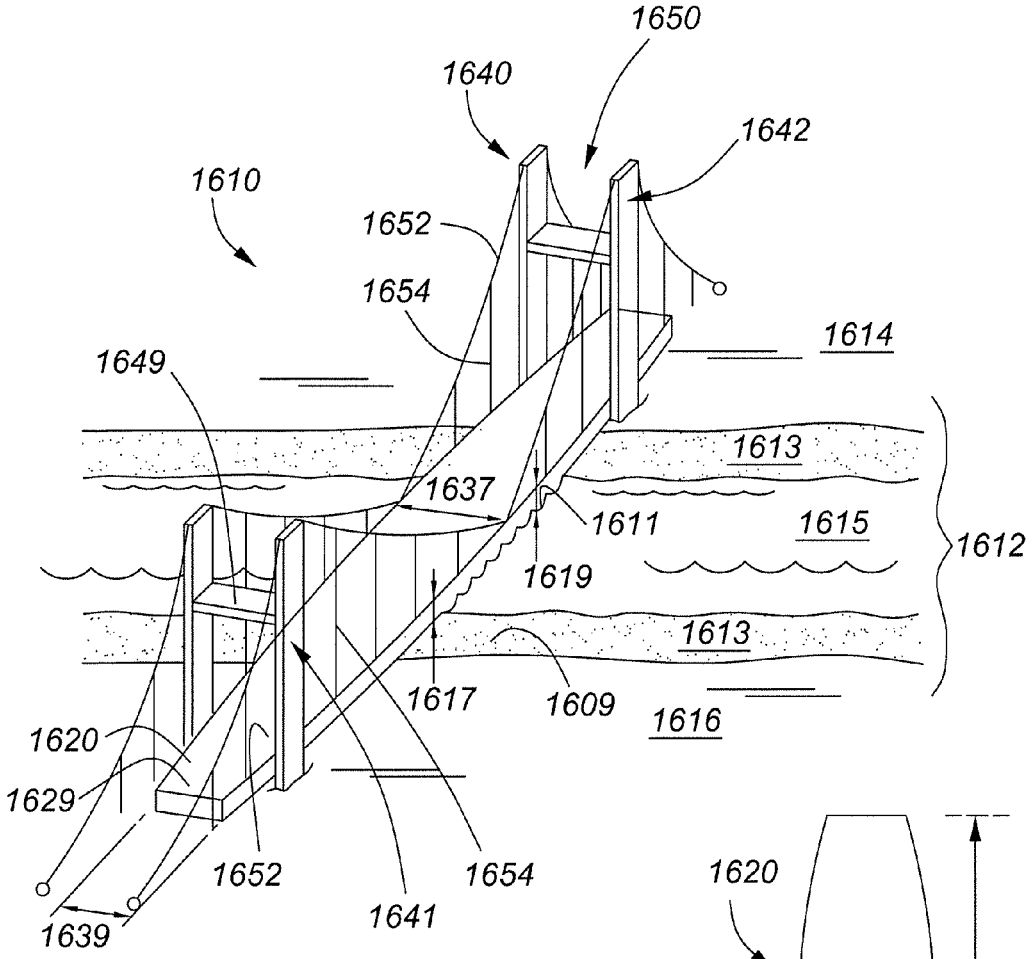
FIG. 21 is a perspective schematic of a two-tower suspension bridge crossing a hydrological surface feature.
Figure 22:
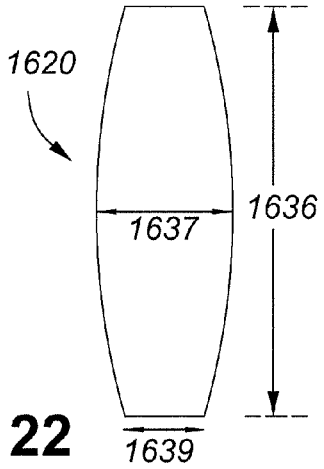
FIG. 22 is a plan view of a deck of the bridge of FIG. 21.
Figure 23:
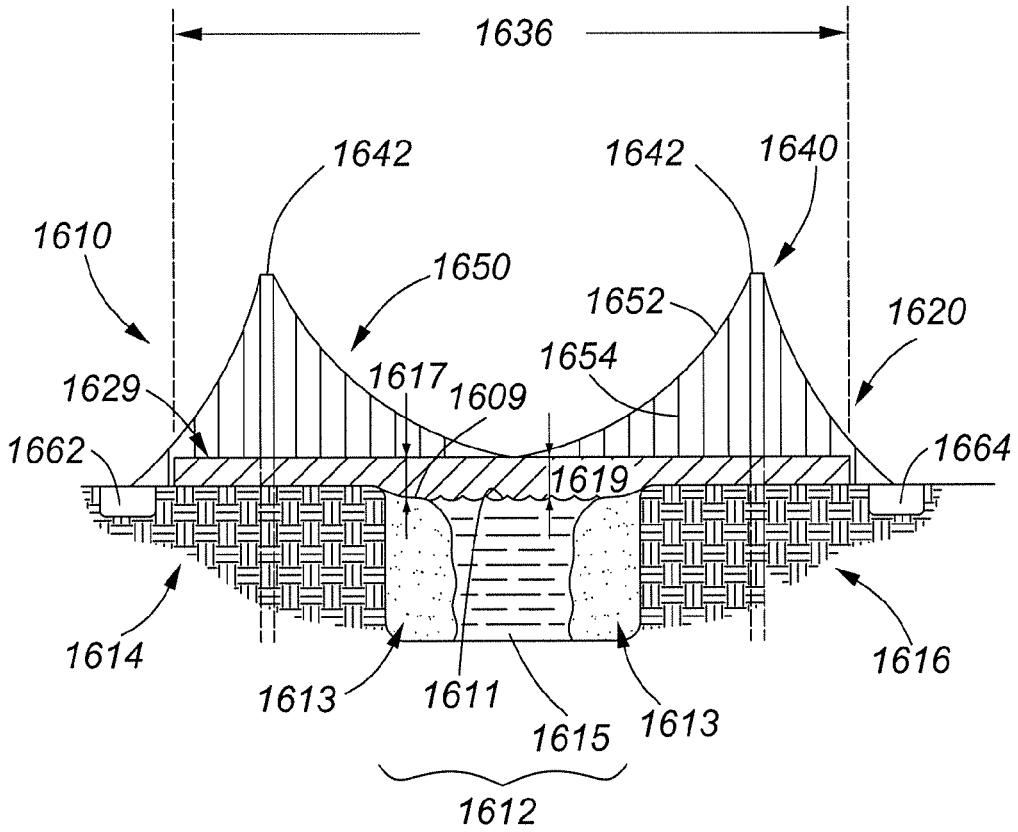
FIG. 23 is a cross-sectional schematic of the bridge of FIG. 21.

FIGS. 21 to 23 are schematics of a bridge 1610 crossing a hydrological surface feature 1612. The hydrological surface feature 1612 includes the two yielding solid portions 1613 proximate each of the first and second stable terrain locations 1614, 1616. The hydrological surface feature 1612 also includes the fluid portion 1615 intermediate the two yielding solid portions 1613. The yielding solid portions 1613 have a greater density than the fluid portion 1615 and provide greater buoyant support to the deck 1620 than the fluid portion 1615.

The bridge 1610 may be applied to the hydrological surface feature 1612 in which buoyant support is reduced, but not absent, over the fluid portion 1615 as compared with the yielding solid portions 1613. The elevation 1619 above the top surface 1611 of the fluid portion 1615 is less than the height of the deck 1620, and the deck 1620 is floating in and buoyantly supported by the fluid portion 1615. The increased surface area afforded by the major width 1637 provides greater buoyant support over the fluid portion 1615 than would be case if the deck 1620 had the minor width 1639 across the fluid portion 1615. This allows greater buoyant support for the bridge 1610 across the hydrological surface feature 1612 compared with buoyant support which would be provided by the bridge 10, which has a consistent width 38 along the length 36 of the deck 20, if the bridge 1610 and the bridge 10 were each located on the same hydrological surface feature 1612 (in contrast with the hydrological surface feature 12). The deck 1620 would also provide greater support than the deck 20 generally (assuming the deck 20 has a width 38 equal to the minor width 1639) but at the engineering cost of additional material and effort required to manufacture a deck 1620 having the major width 1637 and the minor width 1639.

All factors related to expected load, distance between the stable terrain features, and hydrological surface feature density being equal, the minor width 1639 may have a greater width than the minor width 1539 of the deck 1520. The minor width 1639 of the deck 1620 may be comparable in dimensions to the major width 1537 of the deck 1520, where the bridges 1510 and 1610 are designed to have similar lengths 1536 and 1636 and for yielding solid portions 1513 and 1613 having similar densities. Correspondingly, the major width 1637 of the deck 1620 may be greater than either of the minor width 1639 of the deck 1620 or the major width 1537 of the deck 1520. The greater value of the major width 1637 compared with the major width 1537 of the deck 1520 (again, with the lengths 1536 and 1636 being similar and the densities of the yielding solid portions 1513 and 1613 being similar) reflects the role of the major width 1637 of the deck 1620 being for providing additional buoyant support while floating on the relatively low-density fluid portion 1615 (as compared with the higher-density yielding solid portions 1613). In contrast, the role of the major width 1537 of the deck 1520 is to provide additional buoyant support for the deck 1520 along the yielding solid portions 1513 to make up for the total lack of buoyant support of the deck 1520 over the fluid portion 1515.

The bridge 1610 is a suspension bridge with two suspension towers 1642 anchored in the stable terrain portions 1614, 1616. Alternative suspension bridges including tower systems similar to the tower systems 40, 140, or 240, or tensile support systems 50, 150, or 250 may also include the deck 1620 (not shown). Similarly, a stayed bridge including the features of the deck 1620 and the features of the tensile support systems 440, 540, 640, or 740, could also be prepared (not shown). As with the deck 1520, for example applications where the hydrological surface feature includes multiple fluid portions interspersed with yielding solid portions, a deck otherwise similar to the deck 1620 could include alternating portions having the major width or the minor width to accommodate the particular hydrological surface feature.

Examples Only

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art without departing from the scope, which is defined solely by the claims appended hereto.

What is claimed is:

1. A bridge comprising:

a deck defining a length and a width perpendicular to the length, the deck extending along the length across a hydrological surface feature between a first stable terrain location and a second stable terrain location;

a first tower configured to support the deck; and a tensile support system connected with the first tower and with the deck for supporting the deck with a tensile force;

wherein the deck has a sufficiently low deck density and a sufficiently high surface area relative to a hydrological surface feature density to rest on the hydrological surface feature with a top surface of the deck at a selected elevation above a top surface of the hydrological surface feature while supporting a selected load and while the deck is supported by the tensile force.

2. The bridge of claim 1 further comprising a first anchor point on the first stable terrain location and a second anchor point on the second stable terrain location;

the tensile support system comprising:

a first suspension support member extending between the first anchor point, the first tower, and the second anchor point; and a first hanger support member extending between the suspension support member and the deck for suspending the deck from the first suspension support member;

wherein the tensile force is transferred from the deck to the first tower and to the first and second anchor points through suspension of the deck from the first suspension support member by the first hanger support member.

3. The bridge of claim 2 further comprising a second tower configured to support the deck and separated from the first tower along the length, the suspension support member further extending between the first tower and the second tower, and between the second tower and the second anchor point, and wherein the tensile force is further transferred from the deck to the second tower.

4. The bridge of claim 2 wherein:

the tensile support system further comprises a second suspension support member extending between the first anchor point, the first tower, and the second anchor point;

the tensile support system further comprises a second hanger support member extending between the second suspension support member and the deck;

the first suspension support member is separated from the second suspension support member across at least a portion of the width; and the tensile force is further transferred from the deck to the first tower through suspension of the deck from the second suspension support member by the second hanger support member.

5. The bridge of claim 2 wherein the tensile support system further comprises a first plurality of hanger support members separated from each other along the length, each of the first plurality of hanger support member extending between the first suspension support member and the deck for suspending the deck from the first suspension support member, and the tensile force is further transferred from the deck to the first tower through suspension of the deck from the second suspension support member by the first plurality of hanger support members.

6. The bridge of claim 5 wherein:

the tensile support system further comprises a second suspension support member extending between the first anchor point, the first tower, and the second anchor point;

the first suspension support member is separated from the second suspension support member across at least a portion of the width;

the tensile support system further comprises a second plurality of hanger support members separated from each other along the length, each of the second plurality of hanger support members extending between the second suspension support member and the deck for suspending the deck from the second suspension support member, and the tensile force is further transferred from the deck to the first tower through suspension of the deck from the second suspension support member by the second plurality of hanger support members; and the tensile force is further transferred from the deck to the first tower through suspension of the deck from the second suspension support member by the second plurality of hanger support members.

7. The bridge of claim 1 wherein the tensile support system comprises a first stay support member extending between the first tower and the deck for supporting the deck, and the tensile force is transferred from the deck to the first tower through the first stay support member.

8. The bridge of claim 7 further comprising a second tower configured to support the deck and separated from the first tower along the length, wherein the tensile support system comprises a second stay support member extending between the second tower and the deck for supporting the deck, and the tensile force is further transferred from the deck to the second tower through the second stay support member.

9. The bridge of claim 7 wherein the tensile support system further comprises a second stay support member extending between the first tower and the deck for supporting the deck, the first stay support member separated from the second stay support member across at least a portion of the width, and the tensile force is further transferred from the deck to the first tower through the second stay support member.

10. The bridge of claim 7 wherein the tensile support system further comprises a first plurality of stay support members separated from each other along the length, each of the first plurality of stay support members extending between the first tower and the deck for supporting the deck, and the tensile force is further transferred from the deck to the first tower through each of the first plurality of stay support members.

11. The bridge of claim 10 further comprising a second plurality of stay support members separated from each other along the length, the first plurality of stay support members separated from the second plurality of stay support members across at least a portion of the width, each of the second plurality of stay support members extending between the first tower and the deck for supporting the deck, and wherein the tensile force is further transferred from the deck to the first tower through the second plurality of stay support members.

12. The bridge of claim 1 wherein the deck comprises a flow passage defined through the deck for facilitating flow of fluid and suspended components of the hydrological surface feature through the deck.

13. The bridge of claim 12 wherein the flow passage extends through the deck along the width.

14. The bridge of claim 1 further comprising a flow passage defined along the length for facilitating flow of fluids along the length between the first and second stable terrain locations.

15. The bridge of claim 14 wherein the flow passage is defined within the deck.

16. The bridge of claim 14 wherein the flow passage is defined within a conduit extending along the length and connected with the deck.

17. The bridge of claim 14 wherein the flow passage is defined within a pair of conduits extending along the length and connected with the deck, the pair of conduits separated across from each other by at least a portion of the width.

18. The bridge of claim 1 wherein the deck comprises a support matrix for retaining ballast and a surface portion secured on top of the support matrix.

19. The bridge of claim 18 wherein the support matrix comprises a net and a load-support material received within the net for retaining the ballast.

20. The bridge of claim 18 wherein the surface portion comprises a surface material on top of the support matrix and a layer of material at grade on top of the surface material.

21. The bridge of claim 1 further comprising a sidewall extending along at least a portion of the length at a height of the deck crossing a surface of the hydrological surface feature when the top surface of the deck is at the selected elevation, the sidewall having an exterior angle to facilitate urging the deck out of the hydrological surface feature, and mitigating damage to the deck, upon freezing of the hydrological surface feature.

22. The bridge of claim 1, the deck further comprising a rounded bottom extending along at least a portion of the length for stabilizing the bridge.

23. The bridge of claim 1, the deck further comprising a keel extending along at least a portion of the length for breaking a surface tension of the hydrological surface feature when the deck is moved into or out of the hydrological surface feature.

24. The bridge of claim 1 wherein the first tower is anchored within the hydrological surface feature.

25. The bridge of claim 1 wherein the first tower is anchored within the first stable terrain location.

26. The bridge of claim 1 further comprising a first anchor point on the first stable terrain location and a second anchor point on the second stable terrain location.

27. The bridge of claim 26 wherein at least one of the first anchor point and the second anchor point comprises a foundation in at least one of the first stable terrain location and the second stable terrain location.

28. The bridge of claim 26 wherein the deck is anchored to at least one of the first anchor point and the second anchor point.

29. The bridge of claim 26 wherein the tensile support system is anchored to at least one of the first anchor point and the second anchor point.

30. The bridge of claim 26 wherein the first tower is anchored in the first anchor point.

31. The bridge of claim 1 wherein the width comprises a major width extending along a first portion of the length and a minor width extending along a second portion of the length for facilitating greater buoyant support of the deck along the first portion of the length.

32. The bridge of claim 31 wherein the width further comprises the major width extending along a third portion of the length, and the second portion of the length is intermediate the first portion of the length and third portion of the length.

33. The bridge of claim 31 wherein the width further comprises the minor width extending along a third portion of the length, and the first portion of the length is intermediate the second portion of the length and third portion of the length.

34. A method of assembling a bridge across a hydrological surface feature between a first stable terrain location and a second stable terrain location, the method comprising:

providing a deck defining a length and a width perpendicular to the length;

extending the deck across the hydrological surface feature along the length between the first stable terrain location and the second stable terrain location;

providing a first tower for supporting the deck; and connecting a tensile support system with the first tower and with the deck for supporting the deck with a tensile force;

wherein the deck has a sufficiently low deck density and a sufficiently high surface area relative to a hydrological surface feature density to rest on the hydrological surface feature with a top surface of the deck at a selected elevation above a top surface of the hydrological surface feature while supporting a selected load and while the deck is supported by the tensile force.

35. The method of claim 34 wherein connecting the tensile support system with the first tower and with the deck comprises:

providing a first anchor point on the first stable terrain location;

connecting a first suspension support member with the first tower and with the first anchor point; and connecting a first hanger support member with the first suspension support member and with the deck for suspending the deck from the first suspension support member to transfer the tensile force from the deck to the first tower and to the first anchor point through suspension of the deck from the first suspension support member by the hanger support member.

36. The method of claim 35 further comprising:

providing a second anchor point on the second stable terrain location;

providing a second tower for supporting the deck and separated from the first tower along the length; and connecting the first suspension support member with the second tower and with the second anchor point, the first suspension support member extending between the first tower and the second tower, and between the second tower and the second anchor point to transfer the tensile force from the deck to the second tower and to the second anchor point through suspension of the deck from the first suspension support member by the hanger support member.

37. The method of claim 36 wherein providing the first and second anchor points on the first stable terrain location and the second stable terrain location comprises setting foundations at the first stable terrain location and at the second stable terrain location.

38. The method of claim 35 wherein connecting the tensile support system with the first tower and with the deck further comprises:

connecting a second suspension support member with the first anchor point, the first tower, and the second anchor point, the first suspension support member being separated from the second suspension support member across at least a portion of the width; and connecting a second hanger support member with the second suspension support member and with the deck for suspending the deck from the second suspension support member to transfer the tensile force from the deck to the first tower and to the first anchor point through suspension of the deck from the second suspension support member by the second hanger support member.

39. The method of claim 35 wherein connecting the tensile support system with the first tower and with the deck further comprises connecting a first plurality of hanger support members with the first suspension support member and with the deck for suspending the deck from the first suspension support member to transfer the tensile force from the deck to the first tower and to the first anchor point through suspension of the deck from the first suspension support member by the first plurality of hanger support members, each of the first plurality of hanger support members separated from each other along the length.

40. The method of claim 39 wherein connecting the tensile support system with the first tower and with the deck further comprises:

connecting a second suspension support member with the first anchor point, the first tower, and the second anchor point, the first suspension support member being separated from the second suspension support member across at least a portion of the width;

connecting a second hanger support member with the second suspension support member and with the deck for suspending the deck from the second suspension support member; and connecting a second plurality of hanger support members with the second suspension support member and with the deck for suspending the deck from the second suspension support member to transfer the tensile force from the deck to the first tower and to the first anchor point through suspension of the deck from the second suspension support member by the second plurality of hanger support members, each of the second plurality of hanger support members separated from each other along the length.

41. The method of claim 34 wherein connecting the tensile support system with the first tower and with the deck comprises connecting a first stay support member with the first tower and with the deck for supporting the deck, and the tensile force is transferred from the deck to the first tower through the first stay support member.

42. The method of claim 41 further comprising providing a second tower for supporting the deck, and wherein connecting the tensile support system with the deck comprises connecting a second stay support member with the second tower and with the deck for supporting the deck, and the tensile force is further transferred from the deck to the second tower through the second stay support member.

43. The method of claim 41 wherein connecting the tensile support system with the first tower further comprises connecting a second stay support member with the first tower and with the deck for supporting the deck, the first stay support member separated from the second stay support member across at least a portion of the width, and the tensile force is further transferred from the deck to the first tower through the second stay support member.

44. The method of claim 41 wherein connecting the tensile support system with the first tower further comprises connecting a first plurality of stay support members separated from each other along the length, each of the first plurality of stay support members extending between the first tower and the deck for supporting the deck, and the tensile force is further transferred from the deck to the first tower through each of the first plurality of stay support members.

45. The method of claim 44 wherein connecting the tensile support system with the first tower further comprises connecting a second plurality of stay support members with the first tower and with the deck for supporting the deck, the first plurality of stay support members separated from the second plurality of stay support members across at least a portion of the width, and the tensile force is further transferred from the deck to the first tower through the second plurality of stay support members.

46. The method of claim 34 wherein providing the deck comprises securing a support matrix for retaining ballast to each of first and second stable terrain locations to extend between the anchor points, loading the support matrix with ballast, and securing a surface portion on top of the support matrix.

47. The method of claim 46 wherein securing the surface portion on top of the support matrix comprises securing a support material on top of the support matrix and providing a deck surface material at grade on top of the surface material.

48. The method of claim 34 wherein anchoring the first tower proximate the deck comprises anchoring the first tower in the hydrological surface feature.

49. The method of claim 34 wherein anchoring the first tower proximate the deck comprises anchoring the first tower in the first stable terrain location.

50. The method of claim 34 wherein:

the hydrological surface feature comprises a first hydrological surface feature portion and a second hydrological surface feature portion, the first hydrological surface feature portion having a first density which is greater than a second density of the second hydrological surface feature portion, the first hydrological surface feature portion providing greater buoyant support to the deck than the second hydrological surface feature portion;

the width comprises a major width extending along a first deck portion of the length and a minor width extending along a second deck portion of the length for facilitating greater buoyant support of the deck along the first deck portion; and extending the deck across the hydrological surface feature along the length between the first stable terrain location and the second stable terrain location comprises locating the first deck portion over the first hydrological surface feature portion and locating the second deck portion over the second hydrological surface feature portion.

51. The method of claim 50 wherein:

the hydrological surface feature further comprises a third hydrological surface feature portion having a third density comparable to the first density, and the second hydrological surface feature portion is intermediate the first hydrological surface feature portion and the third hydrological surface feature portion;

the width further comprises the major width extending along a third portion of the length, and the second portion of the length is intermediate the first portion of the length and third portion of the length; and extending the deck across the hydrological surface feature along the length between the first stable terrain location and the second stable terrain location further comprises locating the third deck portion over the third hydrological surface feature portion.

52. The method of claim 51 wherein the second deck portion extends across the second hydrological surface feature portion elevated above a surface of the second hydrological surface feature portion, and the deck rests on the hydrological surface feature along the first hydrological surface feature portion and the third hydrological surface feature portion.

53. The method of claim 34 wherein:

the hydrological surface feature comprises a first hydrological surface feature portion and a second hydrological surface feature portion, the first hydrological surface feature portion having a first density which is greater than a second density of the second hydrological surface feature portion, the first hydrological surface feature portion providing greater buoyant support to the deck than the second hydrological surface feature portion;

the width comprises a minor width extending along a first deck portion of the length and a major width extending along a second deck portion of the length for facilitating greater buoyant support of the deck along the first deck portion; and extending the deck across the hydrological surface feature along the length between the first stable terrain location and the second stable terrain location comprises locating the first deck portion over the first hydrological surface feature portion and locating the second deck portion over the second hydrological surface feature portion.

54. The method of claim 53 wherein:

the hydrological surface feature further comprises a third hydrological surface feature portion having a third density comparable to the second density, and the first hydrological surface feature portion is intermediate the second hydrological surface feature portion and the third hydrological surface feature portion;

the width further comprises the major width extending along a third portion of the length, and the first portion of the length is intermediate the second portion of the length and third portion of the length; and extending the deck across the hydrological surface feature along the length between the first stable terrain location and the second stable terrain location further comprises locating the third deck portion over the third hydrological surface feature portion.

* * * * *